US010604959B2

(12) United States Patent
Eickhof et al.

(10) Patent No.: US 10,604,959 B2
(45) **Date of Patent: *Mar. 31, 2020**

(54) COLUMBARIUM WITH INNER OSSUARY

(71) Applicant: Eickhof Columbaria, Inc., Crookston, MN (US)

(72) Inventors: Paul M. Eickhof, Crookston, MN (US); Stephen Noyes, Brooklyn, NY (US); Peter Tollefson, Crookston, MN (US); Blair Hines, Brookline, MA (US); Thomas DeBoer, Crookston, MN (US)

(73) Assignee: Eickhof Columbaria, Inc., Crookston, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/184,762

(22) Filed: Nov. 8, 2018

(65) Prior Publication Data

US 2019/0277052 A1 Sep. 12, 2019

Related U.S. Application Data

(63) Continuation of application No. 15/411,645, filed on Jan. 20, 2017, now Pat. No. 10,125,514.
(Continued)

(51) Int. Cl.
*E04H 13/00* (2006.01)
*A61G 17/08* (2006.01)

(52) U.S. Cl.
CPC ..... *E04H 13/006* (2013.01); *A61G 17/08* (2013.01); *E04H 13/008* (2013.01)

(58) Field of Classification Search
CPC ... E04H 13/006; E04H 13/008; E04H 13/003; E04H 13/001; A61G 17/08
See application file for complete search history.

(56) References Cited

U.S. PATENT DOCUMENTS 750,157 A 1/1904 Bonus
5,692,344 A 12/1997 Zarth
(Continued)

FOREIGN PATENT DOCUMENTS

GB 1512758 6/1978
WO WO 2014020201 2/2014

OTHER PUBLICATIONS

Reflection of Peace, Roselawn Cemetery, http://www.roselawncemetery.com/reflection-of-peace; website, 4 pages, constructed in 2011.

*Primary Examiner* — Rodney Mintz
(74) *Attorney, Agent, or Firm* — Merchant & Gould P.C.

(57) ABSTRACT

A columbarium includes a plurality of storage niches having a first shape and size and disposed about an outer surface of the columbarium. The storage niches form a center chamber having a larger capacity than the storage niches. One or more access niches provide access from an exterior of the columbarium to the center chamber. The access niche has a removable exterior element and an inner portion openable to the center chamber. A delivery system conveys remains from the access niche to the common center chamber. The columbarium has an inscribable designation section separate from the niches to memorialize those interred in the common center chamber. The designation section has a different, shape, size, finish, color or other characteristics to distinguish from the niches.

24 Claims, 28 Drawing Sheets

Related U.S. Application Data

(60) Provisional application No. 62/281,634, filed on Jan. 21, 2016.

(56) References Cited

U.S. PATENT DOCUMENTS

| | | | | |
|---|---|---|---|---|
| D395,121 | S | 6/1998 | Eickhof | |
| 5,765,269 | A | 6/1998 | Zarth | |
| 6,295,705 | B1 | 10/2001 | Gersten | |
| D451,258 | S | 11/2001 | Carrier | |
| 6,553,727 | B2 | 4/2003 | Thomas | |
| 6,634,143 | B1 | 10/2003 | Yoo | |
| 7,937,814 | B2 | 5/2011 | Voit | |
| 8,209,918 | B1 | 7/2012 | Voit | |
| 9,157,252 | B2 * | 10/2015 | School | E04H 13/006 |
| D825,132 | S * | 8/2018 | Eickhof | D99/5 |
| 10,125,514 | B2 * | 11/2018 | Eickhof | A61G 17/08 |
| 10,138,650 | B1 * | 11/2018 | Garcia | E04H 13/006 |
| 10,271,700 | B2 * | 4/2019 | Shinnaka | B08B 5/04 |
| 10,294,690 | B2 * | 5/2019 | Shinnaka | E04H 13/006 |
| 2002/0092247 | A1 | 7/2002 | Thomas | |
| 2010/0180521 | A1 | 7/2010 | Voit | |
| 2015/0052830 | A1 | 2/2015 | School | |
| 2016/0376810 | A1 | 12/2016 | Eickhof | |
| 2017/0211291 | A1 * | 7/2017 | Eickhof | A61G 17/08 |
| 2018/0179778 | A1 | 6/2018 | Tollefson | |
| 2018/0271342 | A1 * | 9/2018 | Shinnaka | B08B 5/04 |
| 2018/0273293 | A1 * | 9/2018 | Shinnaka | E04H 13/008 |
| 2018/0274259 | A1 * | 9/2018 | Shinnaka | E04H 13/006 |
| 2018/0274260 | A1 * | 9/2018 | Shinnaka | E04H 13/006 |

* cited by examiner 400
406
416
404
424
414
414
414
402
408
416
416
414
408
416
414
414
414
416
414
414
416
414
414
416

COLUMBARIUM WITH INNER OSSUARY

BACKGROUND OF THE INVENTION

Field of the Invention

The present invention is directed to a columbarium system and method for interring cremated remains in individual niches or in a common vault using a single ossuary type repository.

Description of the Prior Art

As cost and space issues have led to fewer conventional burials and to a greater number of people choosing cremation, different systems have been developed for handling cremated remains, commonly referred to as cremains, in a dignified and respectful manner. Above ground columbarium systems have multiple storage compartments, commonly referred to as niches, which are able to store urns in a dignified secure manner and provide durability for withstanding exposure to weather for the extended times required. However, even costs of a columbarium having smaller storage spaces then traditional burials or crypts, may be too great, different options, especially less expensive options may be desirable.

Many columbaria are formed in a substantially cylindrical configuration with a layer of individual niches around an exterior of the columbarium with a center open space. This center space is typically not utilized and remains empty. However, the center space is typically protected from the elements by a capstone and the layer of exterior individual niches. The center interior volume provides suitable long term storage chamber for cremains if it can be accessed.

An ossuary provides for interring multiple separate cremated individual cremains in a single repository vault. Although an ossuary may use a common repository, it is still desirable to have a record of the individuals whose cremains are interred to provide a memorial of their final resting place. Therefore, it is desirable to provide a marker of each individual, preferably at or on the structure housing the cremains.

It can also be appreciated that delivery of the cremated remains to a common storage vault should provide for a respectful and dignified delivery of the remains into the vault. Such a delivery system should ensure that the remains cannot get caught to prevent clogs and/or incomplete delivery and should provide for security as well as being weather proof. Moreover, the delivery system should ensure that the cremains containers are evenly distributed in a common repository space.

Traditional urns may not be suitable for being dropped through a delivery system and landing in a vault with other remains. Traditional rigid urns may generate noise when landing in the repository and striking other urns. Moreover, there may also be a risk of the urn cracking or breaking open and/or releasing the cremains. Therefore, the discrete storage of each individual's remains should be configured for delivery to and interment in a common vault.

It is therefore seen that an improved interment system is needed that provides for delivery and permanent storage of cremated remains in a dignified and reverent manner. Such a storage system should provide a structure giving durable weather proof storage in individual niches or a shared repository. The system should also provide a proper record on the structure for the deceased who have been interred. Moreover, such a system should have a safe and reliable delivery system to the common repository that ensures substantially even distribution about the repository. The present invention addresses these as well as other challenges associated with interment systems for cremains.

SUMMARY OF THE INVENTION

The present invention is directed to a columbarium including an inner ossuary as well as individual niches disposed about the exterior of the columbarium. The columbarium and ossuary includes a memorial band in some embodiments providing space for inscriptions in memoriam of cremated remains that are not placed in one of the individual niches and that do not have a corresponding inscription elsewhere. The columbarium also includes a base and a cover, such as a capstone. It can be appreciated that in some embodiments, the base or other areas may be utilized for inscriptions depending upon the particular configuration, the stone used and whether the columbarium is outdoors or is protected from the elements.

The columbarium includes a center common repository vault suitable as an ossuary formed by a vault-type repository wall. The vault wall may be cast from concrete or may be formed of a framework that creates a center repository that is shared by numerous individual cremains, with each individual's cremains in its own discrete container. It can be appreciated that the total number of niches may vary and that the number of sides as well as the height and the geometry of the columbarium may be varied. The individual niches are configured for receiving one or more conventional urns. The geometry may be varied so that fewer or more urns may be placed in a single niche. As with a conventional columbarium, each individual niche may include an inscription on the front to reflect the cremains of the deceased in each niche.

The configuration of the columbarium niches may vary with regard to the number of sides, the height and the total number of niches. The niches are generally each configured with sidewalls, a top and a bottom. It can be appreciated that for the stack of niches, the ceiling of one niche may form the floor of the niche just above it. A frame provides a supporting structure. An inner cover may be used that provides a weather tight enclosure and a weather tight storage compartment. An outer stone shutter is removably placed over each niche with mounting hardware. Such hardware is hidden by the stone shutters and provides for adjustably and removably mounting each shutter for inserting the cremains and also as may be needed while the shutter is removed to add inscriptions.

Moreover, the present invention includes a delivery system configured for delivering cremated remains into the center ossuary in a dignified manner. In one embodiment, the delivery system includes a pivoting chute or slide and a handle as well as hinge or pivot. The hinge allows for the slide to be rotated between a raised position and lowered position. In the lowered position, an inner portion of the slide extends into the access niche while a second inner portion extends beyond the rear of the access niche and into the inner shared repository of the ossuary. A fix slide or ramp may also be used to direct remains into the ossuary.

It can further be appreciated that the memorial band includes a plurality of individual panels removably mounted with hardware. A memorial band panel may be removed to add or update inscriptions as may be necessary and then replaced. It can further be appreciated that the memorial band protrudes outward further than outer surface of the stone shutters to provide a further degree of contrast. To further set the memorial band apart from the other stone surfaces, a contrasting color and/or different type of stone and/or different finish may be utilized for the memorial band. The contrast provides for easily locating and distinguishing the memorial band from the individual niches. It can be appreciated that in some embodiments, the memorial band panels extend across the width of several individual niches. However in other embodiments, the memorial band panel is the same width as individual niches.

The ossuary is specifically adapted for receiving flexible type urns. A flexible urn includes a closable bag portion. The bag portion may include an impermeable liner and a decorative layer. The outer decorative layer may also include an inner fabric liner. The outer decorative layer may be made from satin, velvet or other appropriate fabrics providing a dignified appearance. Moreover, the outer layer may be embroidered and/or may include other graphics, such as religious symbols, as may be desired. The impermeable layer is sealed so that the cremated remains are safely contained within the impermeable liner of the bag. A decorative cord or other closure closes the outer bag layer around the impermeable layer and provides protection of the impermeable layer to avoid tearing, puncture or other damage and prevents any cremated remains from escaping from the flexible-type urn.

A flexible urn may be put into the ossuary through the access niche and the delivery system. While being used for delivery of flexible urns into the ossuary, each access niche will typically not have an inscription on its outer stone shutter and will not store remains. However, it can be appreciated that after the ossuary is full or the particular access niche is no longer needed for providing delivery of flexible urns, the access niche may be used for storing individual conventional urns. The columbarium includes at least one delivery system, although depending on size, more delivery systems and access niches could be utilized.

For a memorial ceremony and interment of cremains, the stone shutter and the inner panel of one of the access niches are removed. The slide is moved to a lowered position and a flexible urn may be placed in the upper surface of the slide. A flexible urn is delivered into the ossuary vault by simply lifting a handle and pivoting the slide upward. The flexible urn then descends along the slide and drops into the open vault of the ossuary. The inner portion of the slide closes off the rear of the access niche to provide added security and separation of the vault and the access niche. After the cremains are deposited, the inner cover and outer stone shutter are replaced and the columbarium retains its fully closed appearance. Separately, one of the memorial band panels is removed to add an inscription to reflect the interment into the ossuary.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

DETAILED DESCRIPTION OF THE PREFERRED EMBODIMENT

Figure 1:
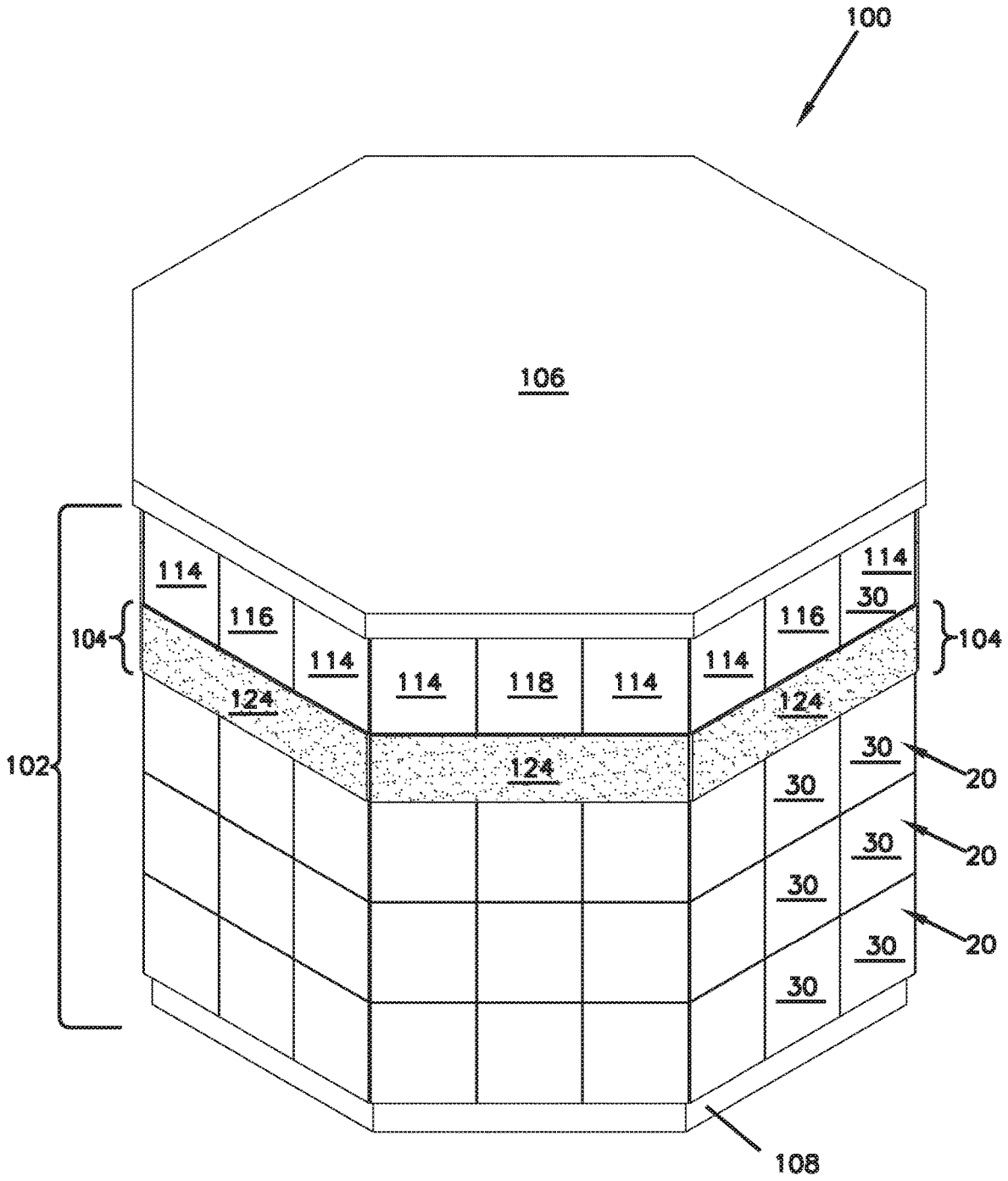
FIG. 1 is a perspective view of a first embodiment of a columbarium and ossuary system according to the principles of the present invention.
Figure 2:
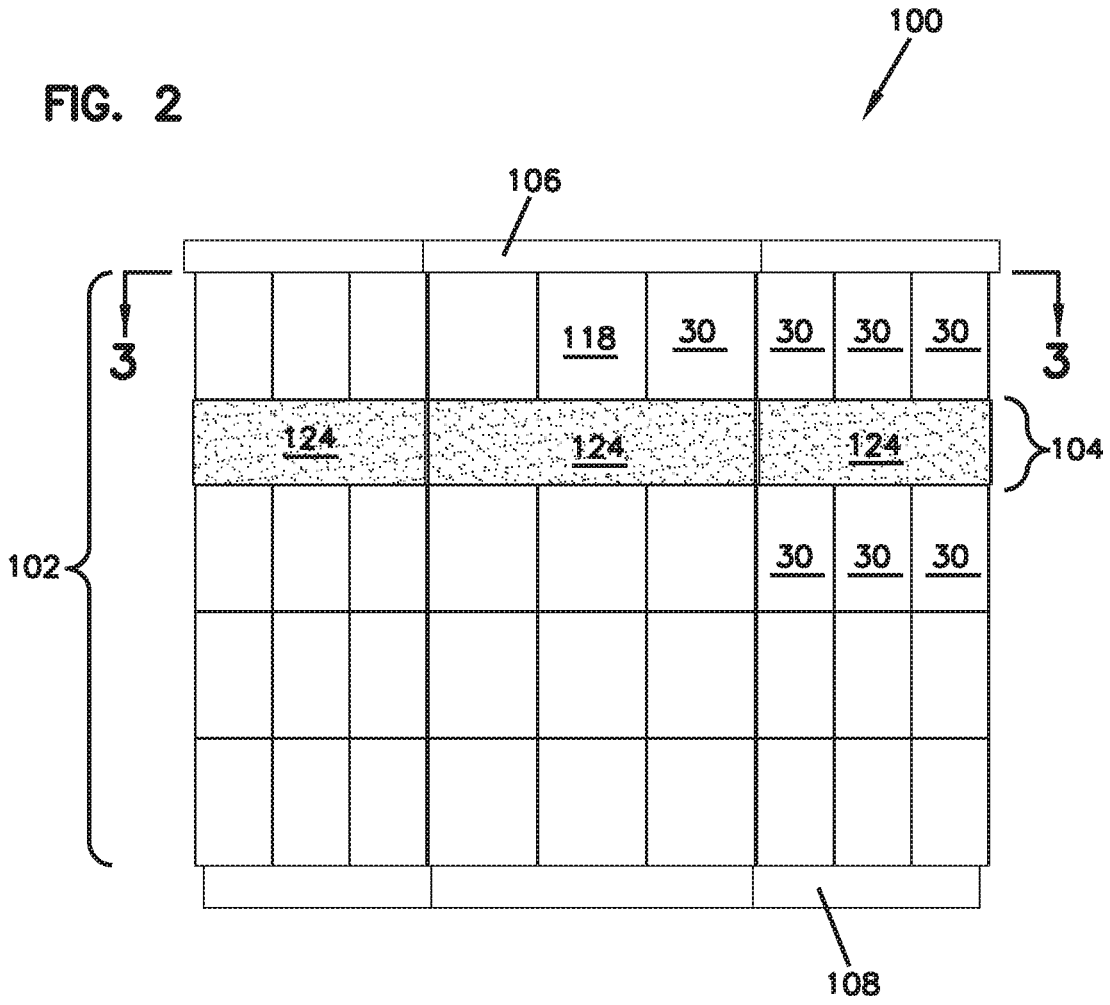
FIG. 2 is a side elevational thereof.

Referring now to the drawings and in particular to FIGS. 1 and 2, there is shown a first embodiment of an example columbarium, generally designated (100). The columbarium (100) includes an inner ossuary (110), shown in FIG. 3, in addition to an array of individual niches (102). The columbarium (100) and ossuary (110) includes a memorial band (104) providing space for inscriptions for cremated remains that are not in one of the individual niches (102) and that do not have a corresponding inscription elsewhere. The columbarium (100) also includes a cover (106) such as a capstone and a base (108). It can be appreciated that in some embodiments, the base (108) and/or cover (106) may be utilized for inscriptions depending upon the particular configuration, the stone used and the installation site.

Figure 3:
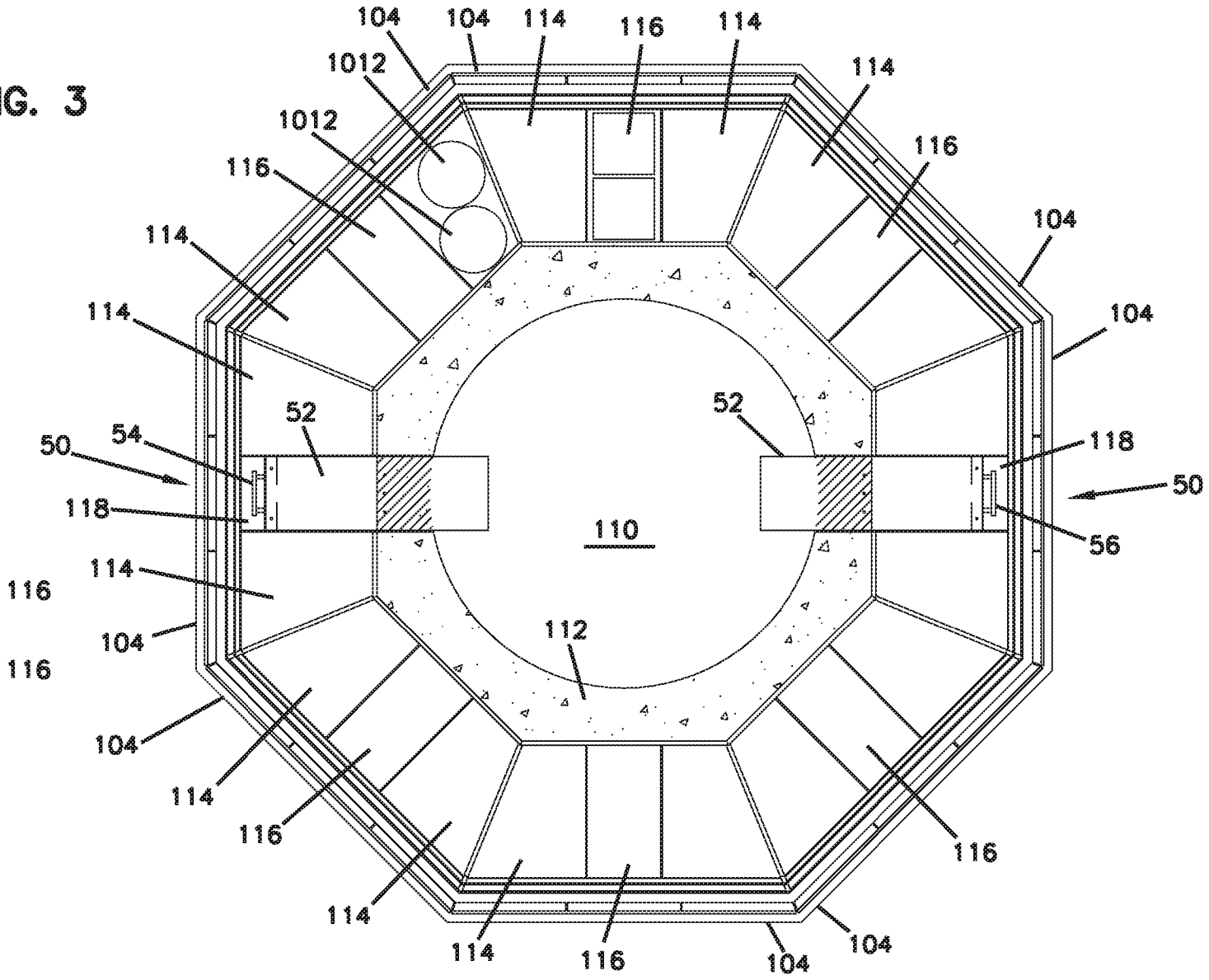
FIG. 3 is a side sectional view taken along line 3-3 of FIG. 2.
Figure 4:
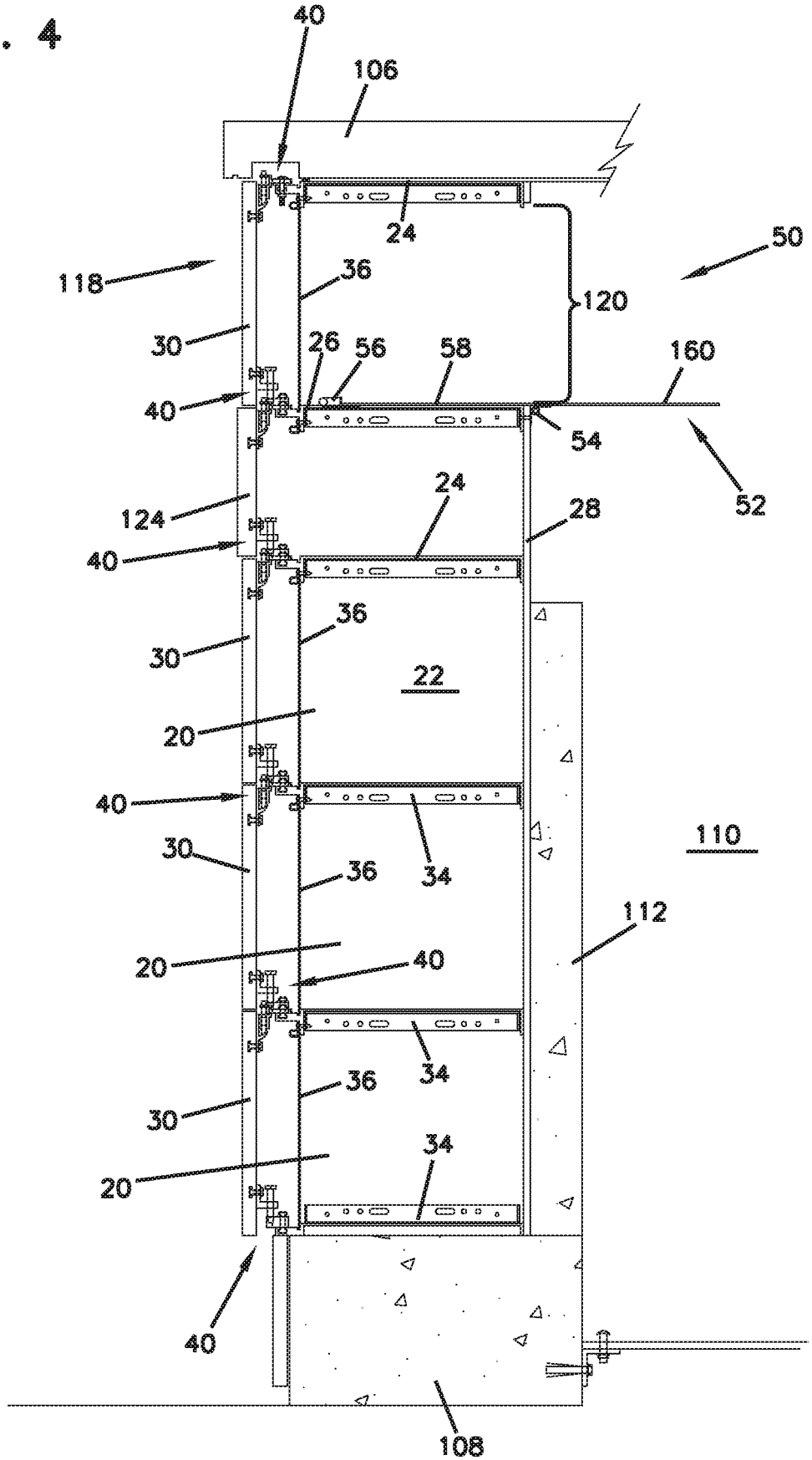
FIG. 4 is a side sectional view through an access niche for the columbarium and ossuary shown in FIG. 1.
Figure 5:
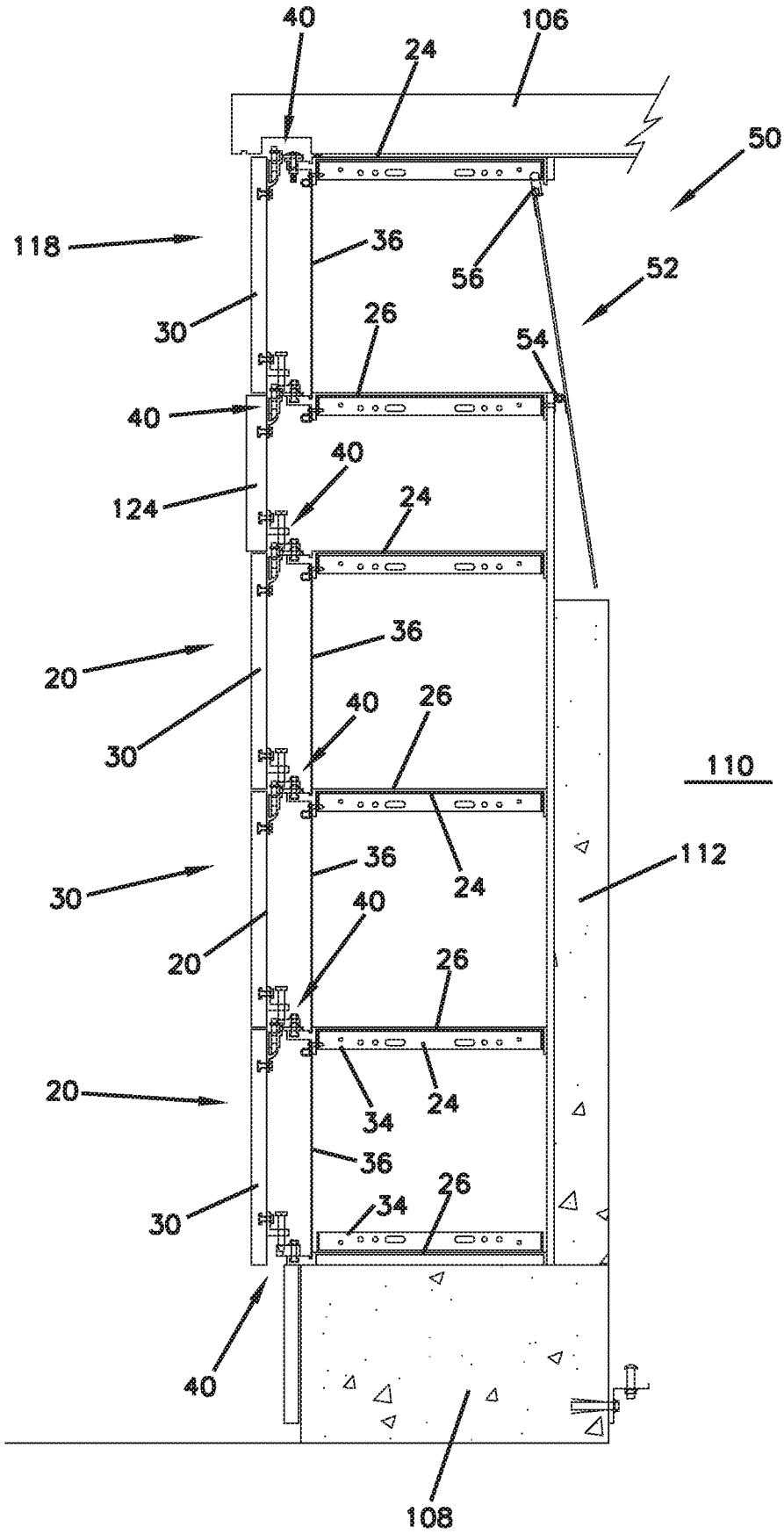
FIG. 5 is a side sectional view through the access niche with the slide pivoted downward for depositing a cremains container into the center ossuary.

Referring now to FIG. 3, it can be appreciated that the columbarium (100) includes a center common repository vault (110) suitable as an ossuary formed by a vault-type repository wall (112). The vault wall (112) may be cast from concrete or may be formed of a framework that creates a center repository that is shared by numerous individual cremains, with each individual's cremains in its own discrete container. In the embodiment shown in FIGS. 1-5, the columbarium (100) has 8 sides that define corner niches (114), center niches (116) and access niches (118). It can be appreciated that the total number of niches may vary and that the number of sides as well as the height and the geometry of the columbarium may be varied. Examples are shown in the other embodiments but further configurations are also possible that include a common center ossuary (110). The corner niches (114) and center niches (116) are configured as conventional columbarium niches (20) as shown in FIGS. 4 and 5. The niches are configured for receiving one or more conventional urns (1012), as shown in FIG. 3. The geometry may be varied so that fewer or more urns (1012) may be placed in a single niche. As with a conventional columbarium, each individual niche (20) may include an inscription on the front to reflect the cremains of the deceased in each niche.

Referring to FIGS. 4 and 5, the configuration of the columbarium niches may vary with regard to the number of sides, the height and the total number of niches, however the general structure of each niche does not vary from embodiment to embodiment and the description of FIGS. 4 and 5 generally applies to all embodiments. The niches (20) are generally each configured with sidewalls (22), a top (24) and a bottom (26). It can be appreciated that for the stack of niches (20), the top (24) of one niche may form the bottom (26) of the niche just above it. A frame (34) provides a supporting structure. An inner cover (36) provides a weather tight enclosure and a weather tight storage compartment. An outer stone shutter (30) is placed over each niche (20) with mounting hardware (40). Such hardware (40) is hidden by the stone shutters (30) and provides for removably mounting each shutter for inserting the cremains and also as may be needed while the shutter (30) is removed to add inscriptions.

Moreover, the present invention includes a delivery system generally designated (50) for the embodiment shown in FIGS. 3-5. The delivery system (50) is configured for delivering cremated remains into the center ossuary (110) in a dignified manner. The delivery system (50) includes the pivoting chute or slide (52) and a handle (56) as well as hinge or pivot (54). The hinge (54) allows for the slide to be rotated between the position shown in FIGS. 4 and 5. In the position shown in FIG. 4, an inner portion (58) of the slide (52) extends into the access niche (118) while a second portion (60) extends beyond the rear of the access niche (118) and into the inner shared repository of the ossuary (110).

It can further be appreciated that the memorial band, designated (104) in the first embodiment, includes a plurality of individual panels (124) removably mounted with hardware (40). A memorial band panel (124) may be removed to add or update inscriptions as may be necessary and then replaced. It can further be appreciated that the memorial band (104) protrudes outward further than outer surface of the stone shutters (30) to provide a further degree of contrast. To further set the memorial band (104) apart from the other stone surfaces, a contrasting color and/or different type of stone and/or different finish may be utilized for the memorial band (104). The contrast provides for easily locating and distinguishing the memorial band (104) from the individual niches. It can be appreciated that in some embodiments, the memorial band panels (124) extend across the width of several individual niches, as shown in FIGS. 1-3 for memorial band panels (124). However in other embodiments, the memorial band panel is the same width as individual niches.

Figure 6:
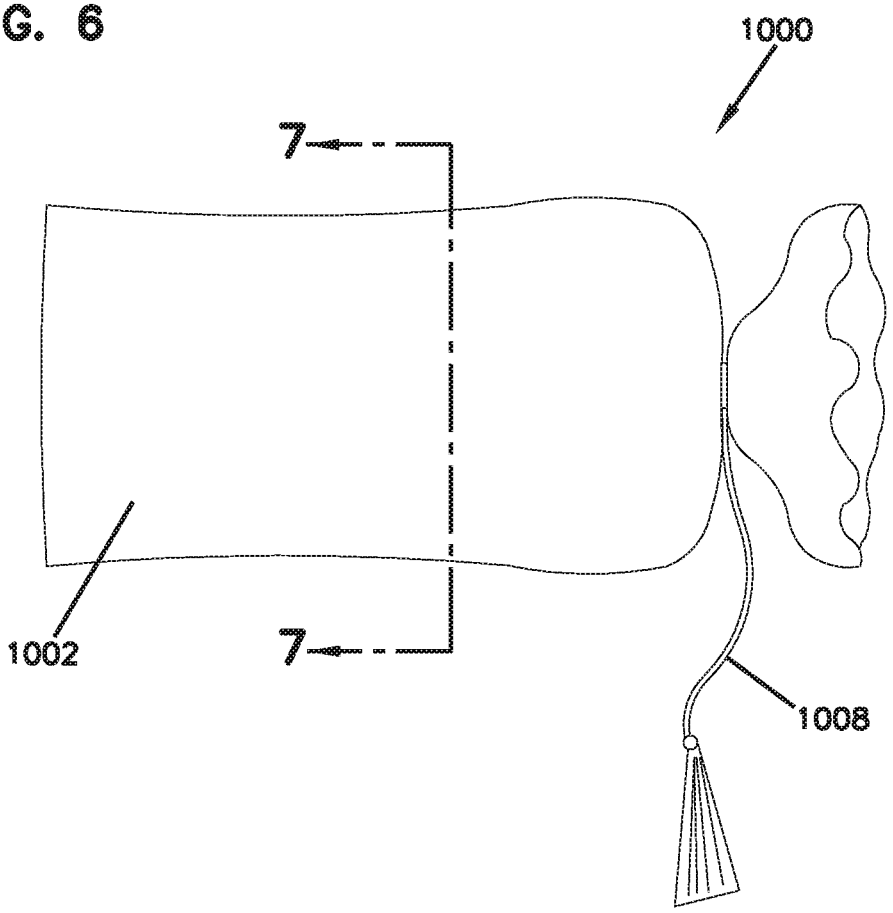
FIG. 6 is a side elevational view of a flexible cremains container for use with the columbarium and ossuary system shown in FIG. 1.
Figure 7:
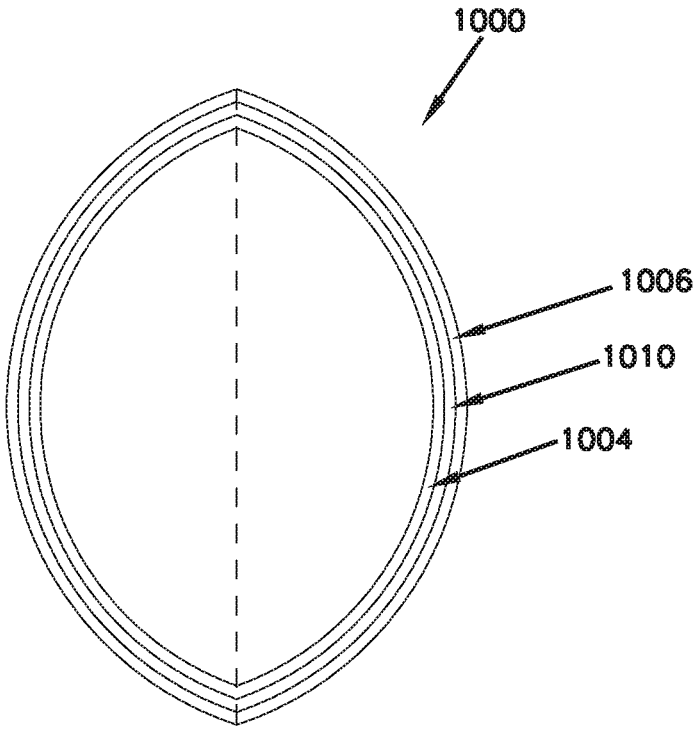
FIG. 7 is a side sectional view taken along line 7-7 of FIG. 6.
Figure 8:
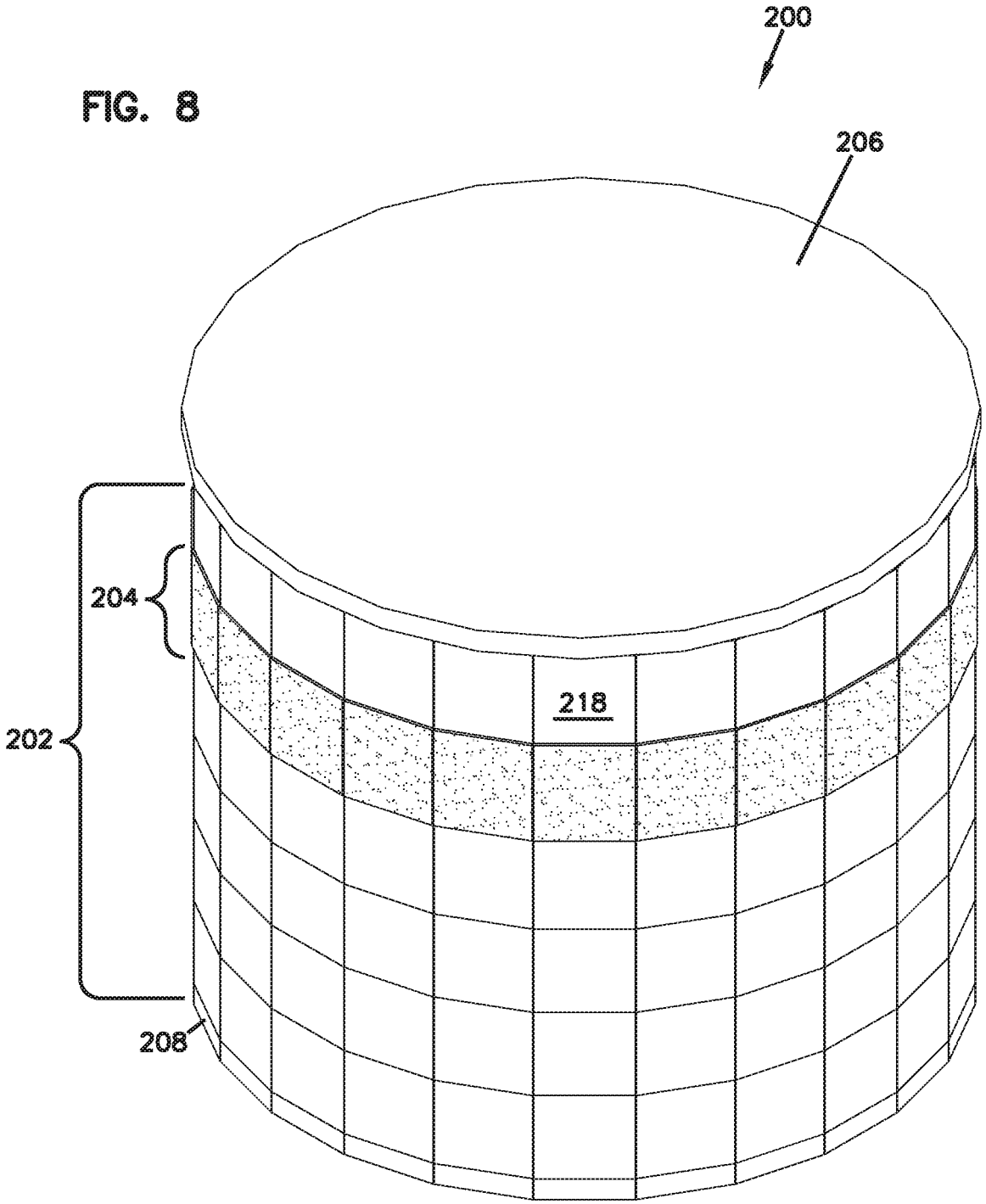
FIG. 8 is a perspective view of a second embodiment of a columbarium and ossuary system according to the principles of the present invention.
Figure 9:
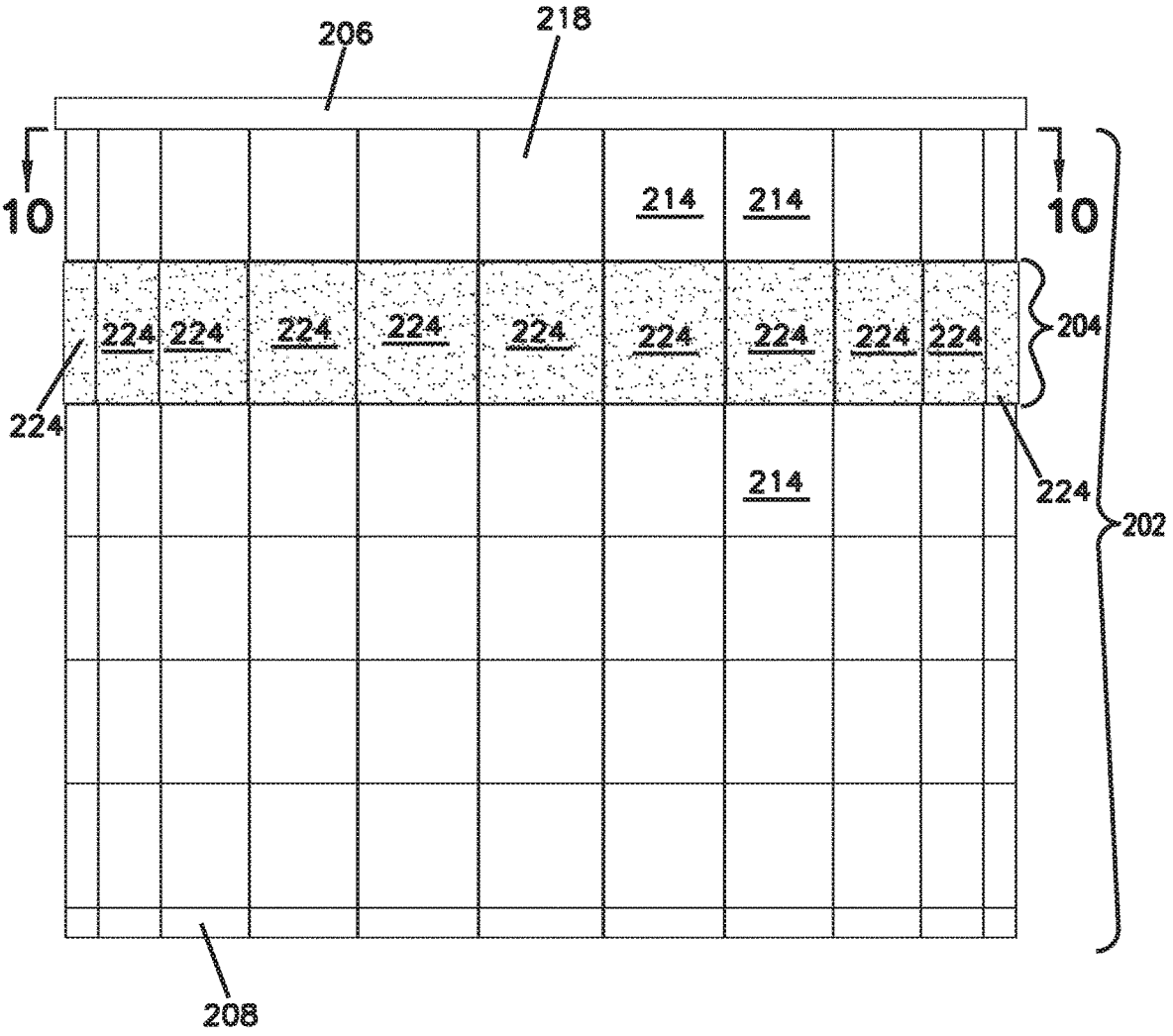
FIG. 9 is a side elevational thereof.

Referring now to FIGS. 6 and 7, the ossuary is specifically adapted for receiving flexible type urns (1000). The flexible urn (1000) includes a closable bag portion (1002). In a preferred embodiment, the bag portion (1002) includes an impermeable liner (1004) and an outer decorative layer (1006), as shown in FIG. 7. The outer decorative layer (1006) may also include an inner fabric liner (1010). The outer decorative layer (1006) may be made from satin, velvet or other appropriate fabrics providing a dignified appearance. Moreover, the outer layer (1006) may be embroidered and/or may include other graphics, such as religious symbols, as may be desired. The impermeable layer (1004) is sealed so that the cremated remains are safely contained within the impermeable liner (1004) of the bag (1002). A decorative cord or other closure (1008) closes the outer bag layer (1006) around the impermeable layer (1004) and provides protection of the impermeable layer (1004) to avoid tearing, puncture or other damage and prevents any cremated remains from escaping from the flexible-type urn (1000).

Referring again to FIGS. 3-5, a flexible urn may be put into the ossuary (110) through the access niche (118) and the delivery system (50). While being used for delivery of flexible urns (1000) into the ossuary (110), each access niche (118) will typically not have an inscription on its outer stone shutter (30). However, it can be appreciated that after the ossuary (110) is full or the particular access niche (118) is no longer needed for providing delivery of flexible urns, the access niche (118) may be used for storing individual conventional urns (1012). In the embodiment shown in FIG. 3, the columbarium (100) includes two delivery systems (50) although depending on size, more delivery systems (50) and access niches (118) could be utilized. The multiple delivery systems (50) provide for evenly distributing of the flexible urns within the vault of the ossuary (110).

For a memorial ceremony and interment of cremains, the stone shutter (30) and the inner panel (36) of one of the access niches (118) are removed. The slide (52) is moved to the position shown in FIG. 4. With open access, a flexible urn may be placed in the upper surface of the slide, typically on the portion (58) within the access niche (118). When placed in this position, a flexible urn is delivered into the ossuary vault (110) by simply lifting the handle (56) and pivoting the slide (52) upward. The flexible urn then descends along the slide and drops into the open vault of the ossuary (110). The inner portion (58) of the slide (52) then closes off the rear of the access niche (118) to provide added security and separation of the vault (110) and the access niche (118). The slide (52) may be configured so that it is balanced about the pivot (54) and may rest in either the position shown in FIG. 4 or FIG. 5 or a latch or other retainer may be utilized to maintain the slide at the position at one or both of the positions. After the cremains are deposited, the inner cover (36) and outer stone shutter (30) are replaced and the columbarium (100) retains its fully closed appearance. Separately, one of the memorial band panels (124) is removed to add an inscription to reflect the interment into the ossuary (110).

Referring now to FIGS. 8-11, there is shown a second embodiment of an example columbarium (200). The columbarium (200) also includes an inner ossuary (210) similar to that shown in FIGS. 3-5. Columbarium (200) includes an array (202) of individual niches (214). A memorial band (204) extends around a periphery of the columbarium (200) below a top row of the niches (214). A cover (206) has 24 sides to match the 24 columns of the niches (214) extending about a periphery of the columbarium. The memorial band (204) includes contrasting memorial band panels (224). It will be noted that in a second embodiment, the memorial band panels (224) are the same width as niche covers (222). It will be appreciated that the interior of the columbarium includes ossuary (210) formed by an inner wall (212). Access niches (218) are similar to the access niche (118). In the embodiment shown in FIGS. 8-11, there are four access niches (218) disposed evenly around the top row of niches of the columbarium (200). Although five tiers of niches (20) under the memorial band and one tier of niches (20) above the memorial band are, shown the height, geometry and circumference of the columbarium is adjustable to accommodate the desired number of niches. The construction of each niche (20) is generally the same as that described above with regard to the first embodiment. However, a delivery system (70) has a similar same general configuration as the delivery system (50); the delivery system (70) is fixed with a ramp portion (72) extending into the ossuary vault (11). Moreover, the columbarium (200) includes four separate access niches (218), each having an associated delivery system (70) with four separate ramps (72) with the embodiment shown in FIGS. 8-11. However, the number of access niches and delivery systems may vary depending upon the size and requirements of the columbarium and ossuary. Moreover, it can be appreciated that columbarium may utilize either the delivery system (50) having a rotatable slide or the delivery system (70) have a fixed ramp.

Figure 14:
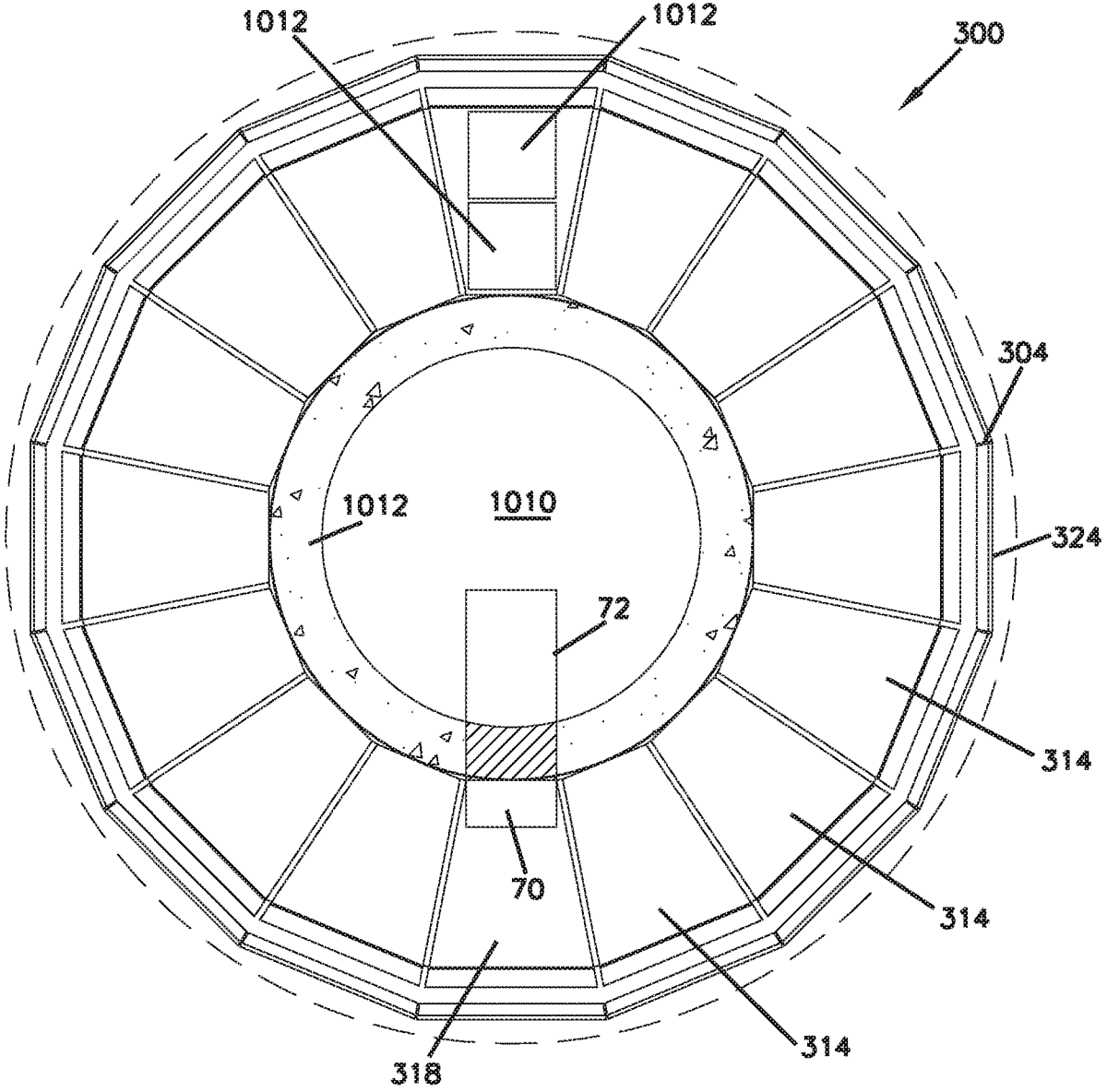
FIG. 14 is a side sectional view taken along line 14-14 of FIG. 13.
Figure 15:
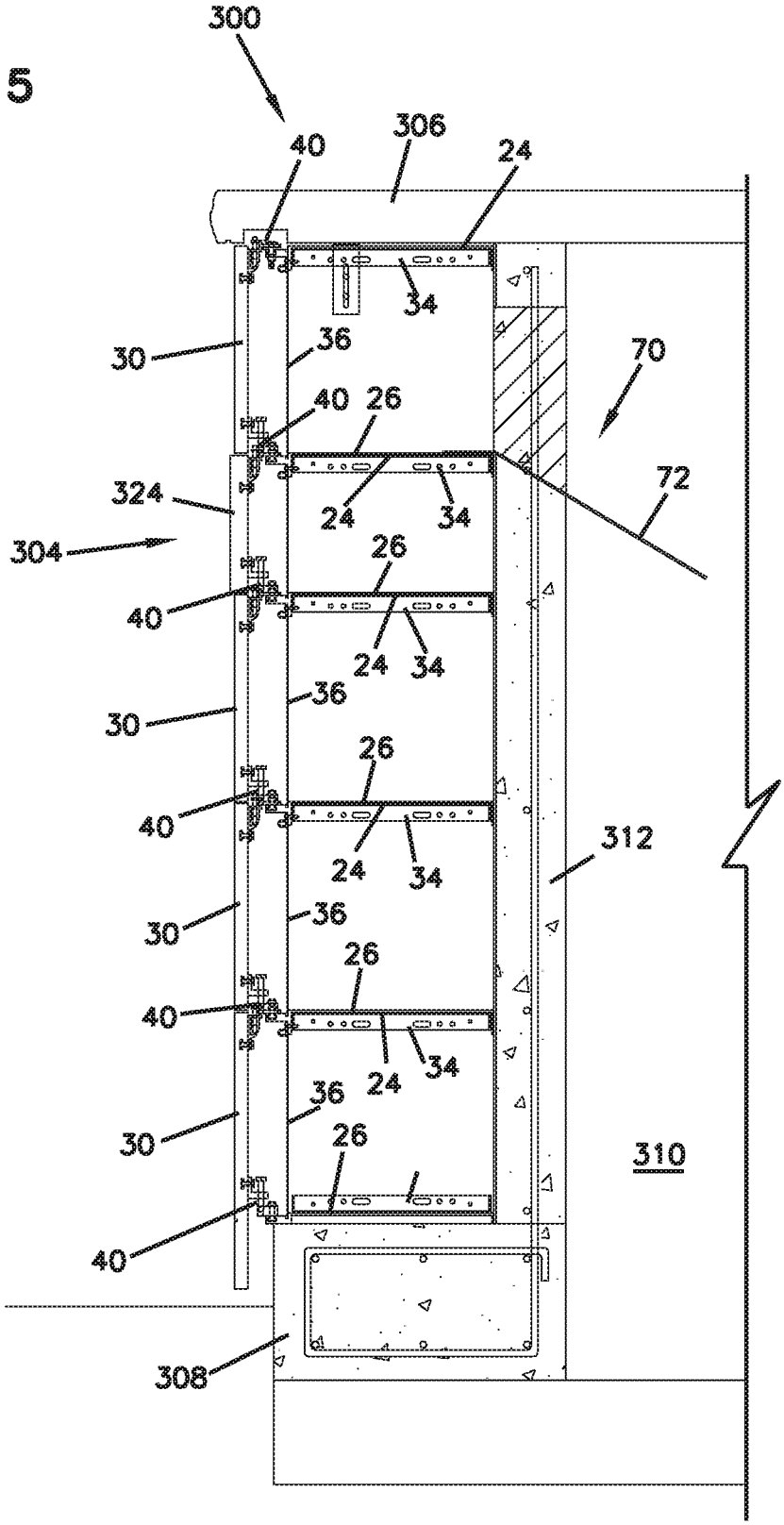
FIG. 15 is a side sectional view of the niches taken through an access niche for the columbarium and ossuary shown in FIG. 12.
Figure 16:
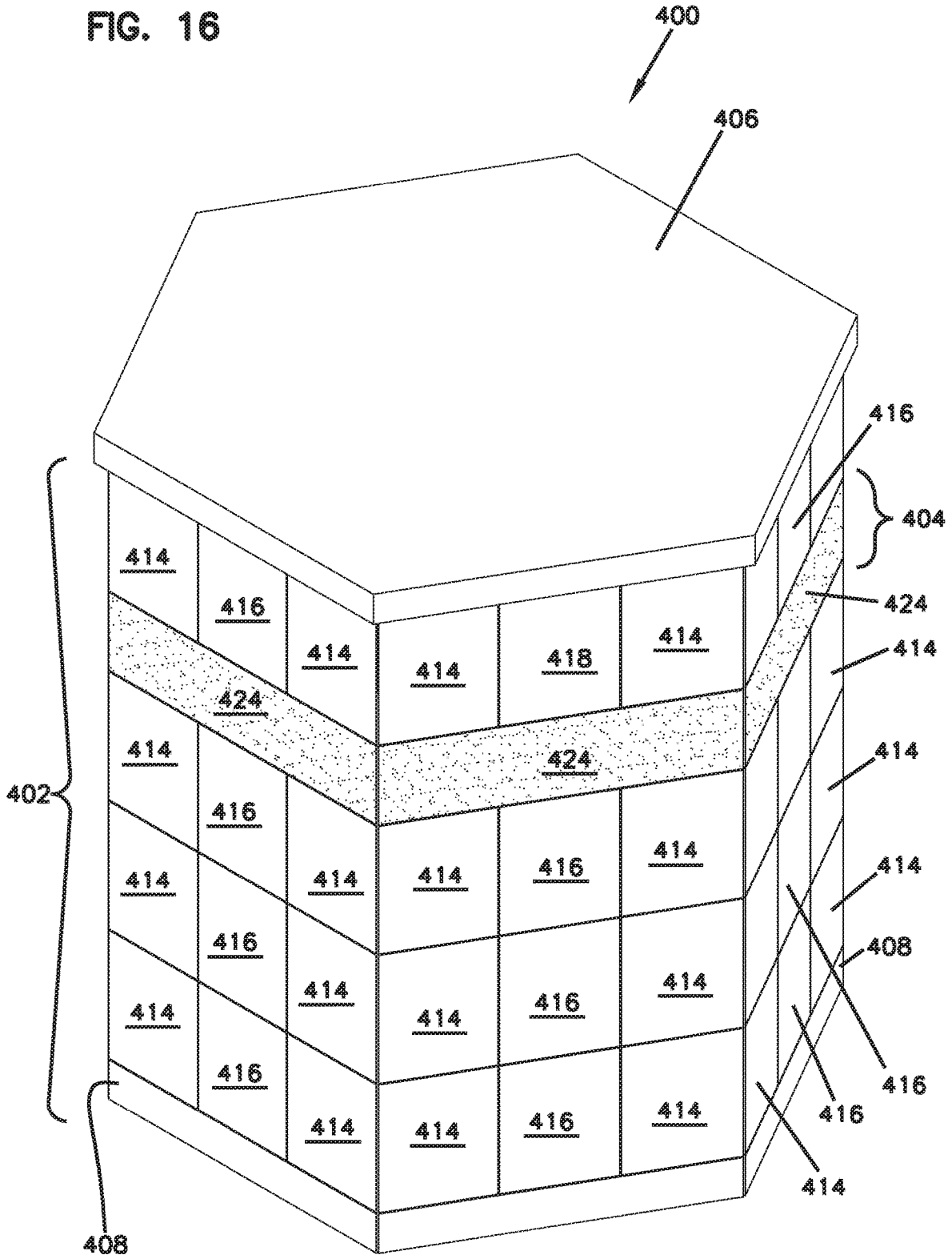
FIG. 16 is a perspective view of a fourth embodiment of a columbarium and ossuary system according to the principles of the present invention.
Figure 17:
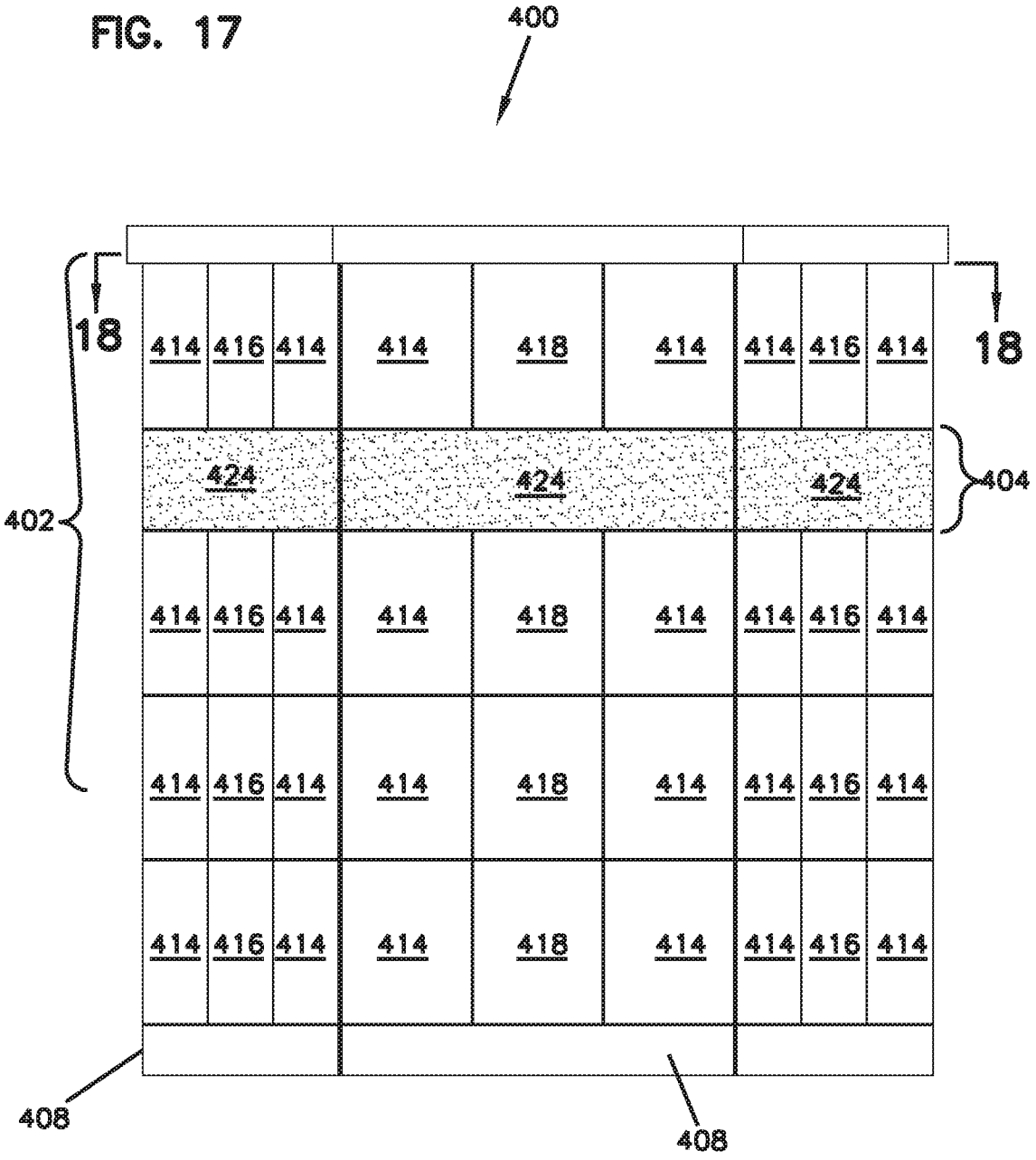
FIG. 17 is a side elevational thereof.
Figure 18:
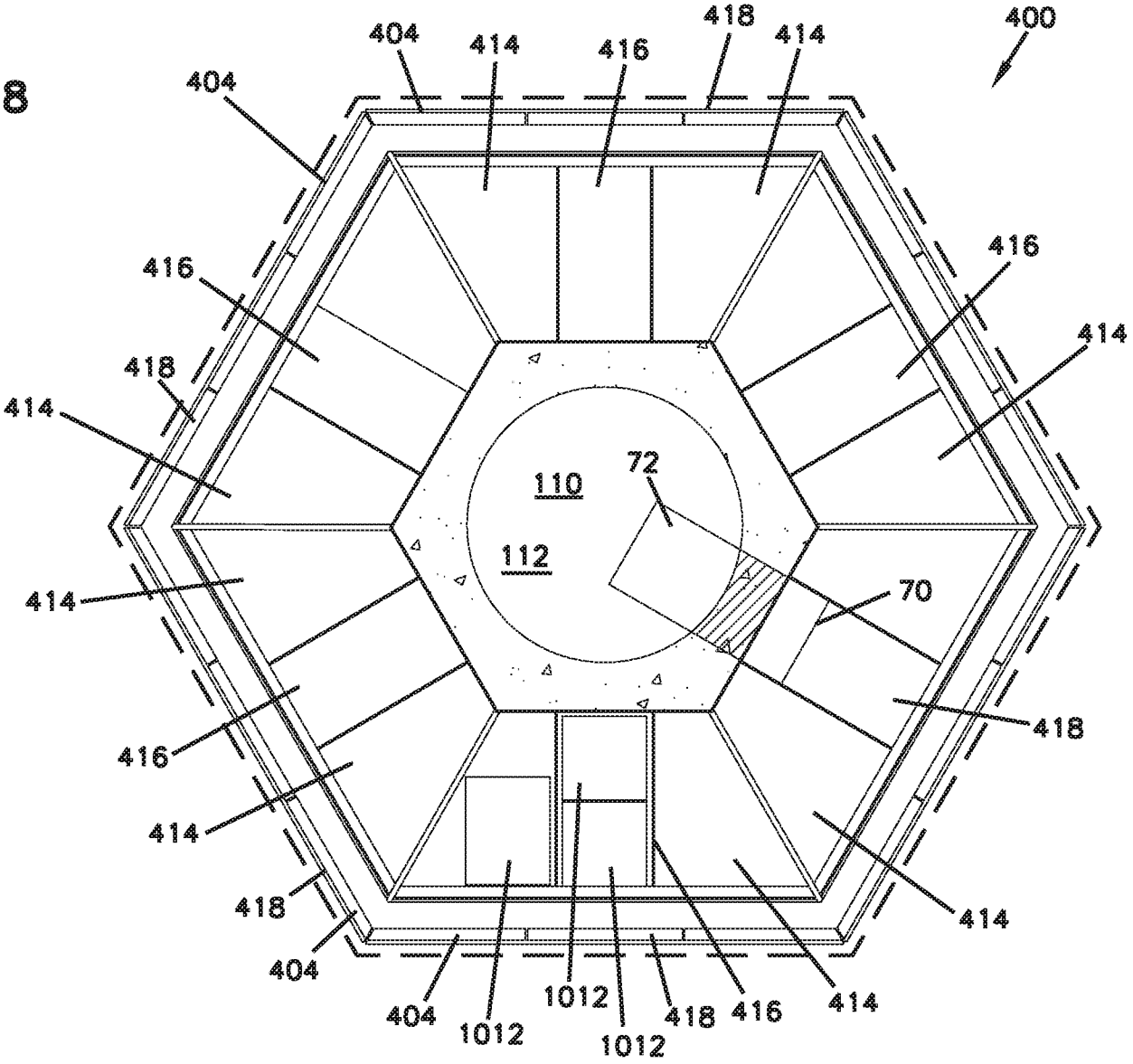
FIG. 18 is a side sectional view taken along line 18-18 of FIG. 17.

Referring now to FIGS. 12-15, there is shown a third embodiment of an example columbarium, with an inner ossuary, generally designated (300). The columbarium (300) includes an array (302) of rows and columns of individual niches (314) and a memorial band (304). The memorial band (304) has individual panels (324) that project outwardly beyond the stone shutters of the individual niches (314). Moreover, the panels (324) may have a contrasting color, finish or other appearance to set them apart from the other shutters (30). A cover (306) has 16 sides to reflect the 16 columns of niches (314) disposed about a periphery of the columbarium (300). The base (308) provides support at the bottom of the columbarium (300). Referring now to FIGS. 14 and 15, the columbarium (300) includes an inner ossuary vault (310) formed by a vault wall (312). There may be a single access niche and a single delivery system (70) in the embodiment of the columbarium (300) due to a smaller inner capacity. However, other niches (314) could be configured as access niches (318).

Figure 19:
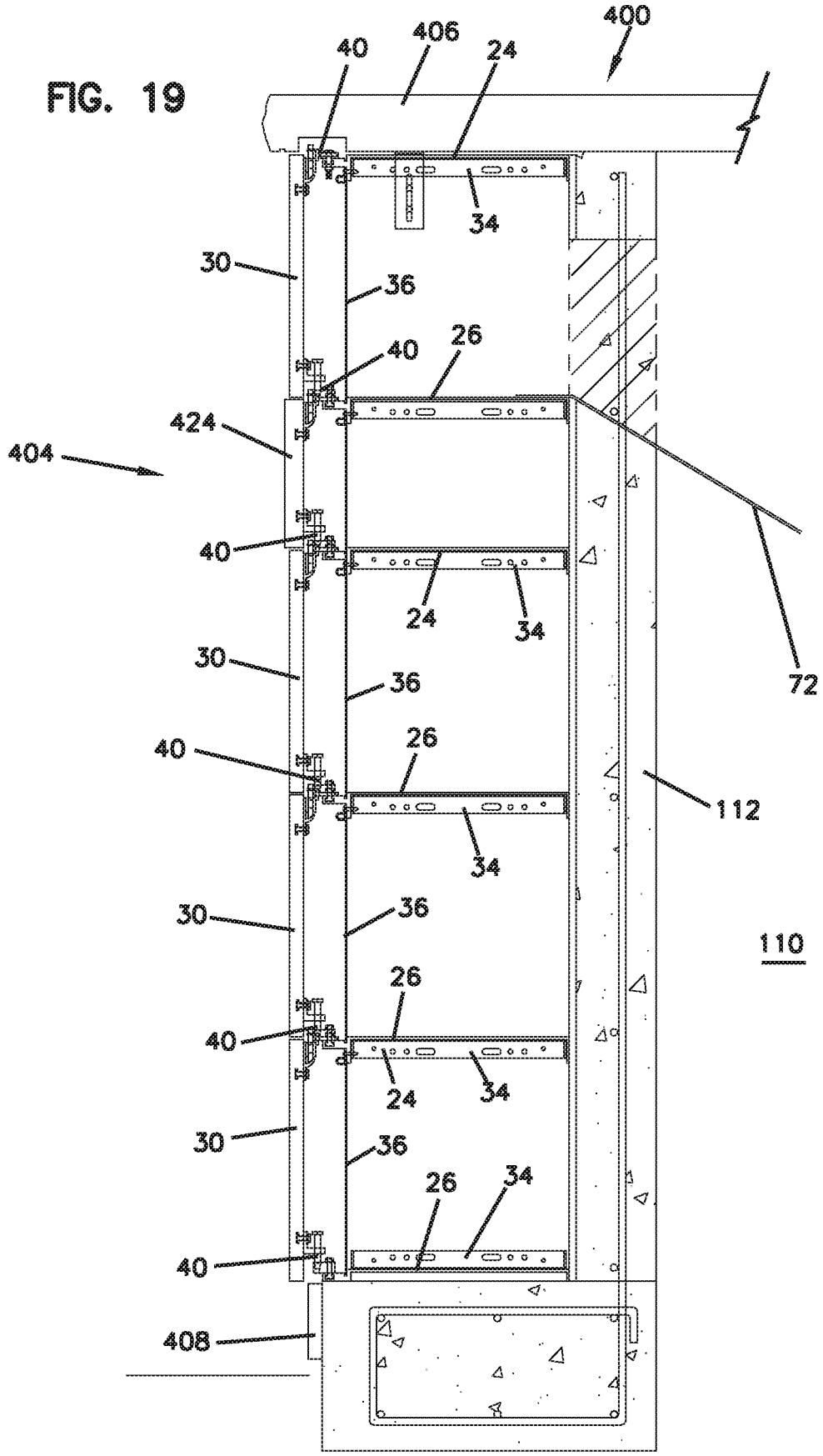
FIG. 19 is a side sectional view of the niches taken through an access niche for the columbarium and ossuary shown in FIG. 16.

Referring now to FIGS. 16-19, there is shown a fourth embodiment of an example columbarium with an inner ossuary, generally designated (400). The columbarium (400) has 6 sides and has a cover (406) with 6 sides. An array (302) of columns and rows of niches (314) are disposed about a periphery of the columbarium. A memorial band (404) includes individual memorial band panels (424) that extend across the width of 3 individual niches with there being a total of 6 individual memorial band panels (424) reflecting the 6 sides of the columbarium (400). The memorial band panels protrude slightly outward relative to the shutters of the individual niches (414). A central ossuary (410) is formed by a vault wall (412). The embodiment shown includes a single access niche (418) with a delivery system (70) having a fixed slide (72). The rows below the access niche (418) and other sides include corner niches (414) and center niches (416). It can be appreciated that the storage capacity is slightly different between the center niches (416) and the corner niches (414). As shown in FIG. 19, a delivery system (70) is utilized with a rear opening (432) in the access niche (418) that may be closed when not in use. Fixed slide or ramp (72) is permanently affixed and includes a downwardly angled portion extending into the open central ossuary (410). Although a permanently mounted slide or ramp (72) shown, as with the other embodiments, it can be appreciated that a pivoting slide (52) could also be utilized.

Figure 20:
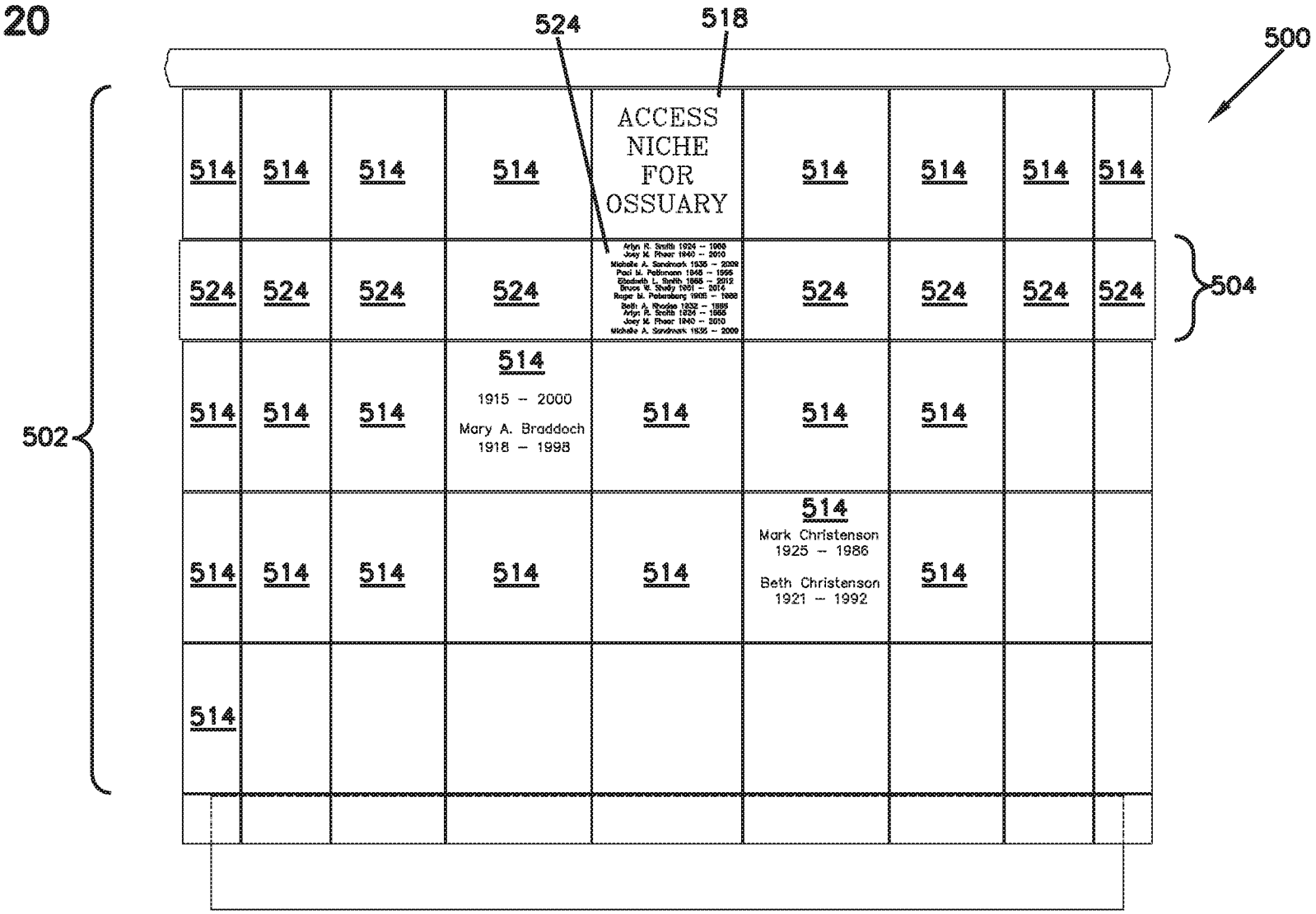
FIG. 20 is a side elevational view of a fifth embodiment of a columbarium and ossuary system according to the principles of the present invention.
Figure 21:
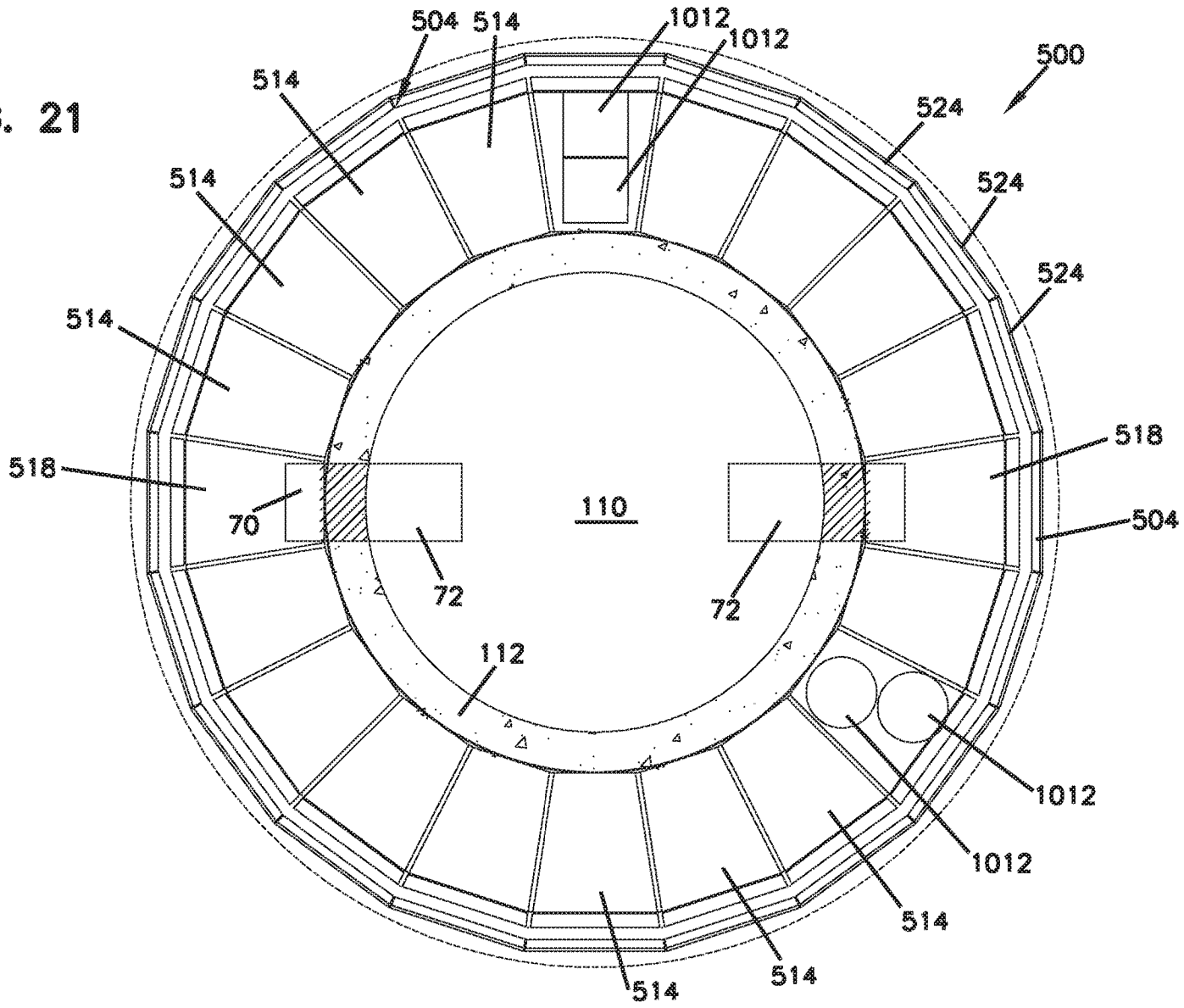
FIG. 21 is a side sectional view taken along line 21-21 of FIG. 20.
Figure 22:
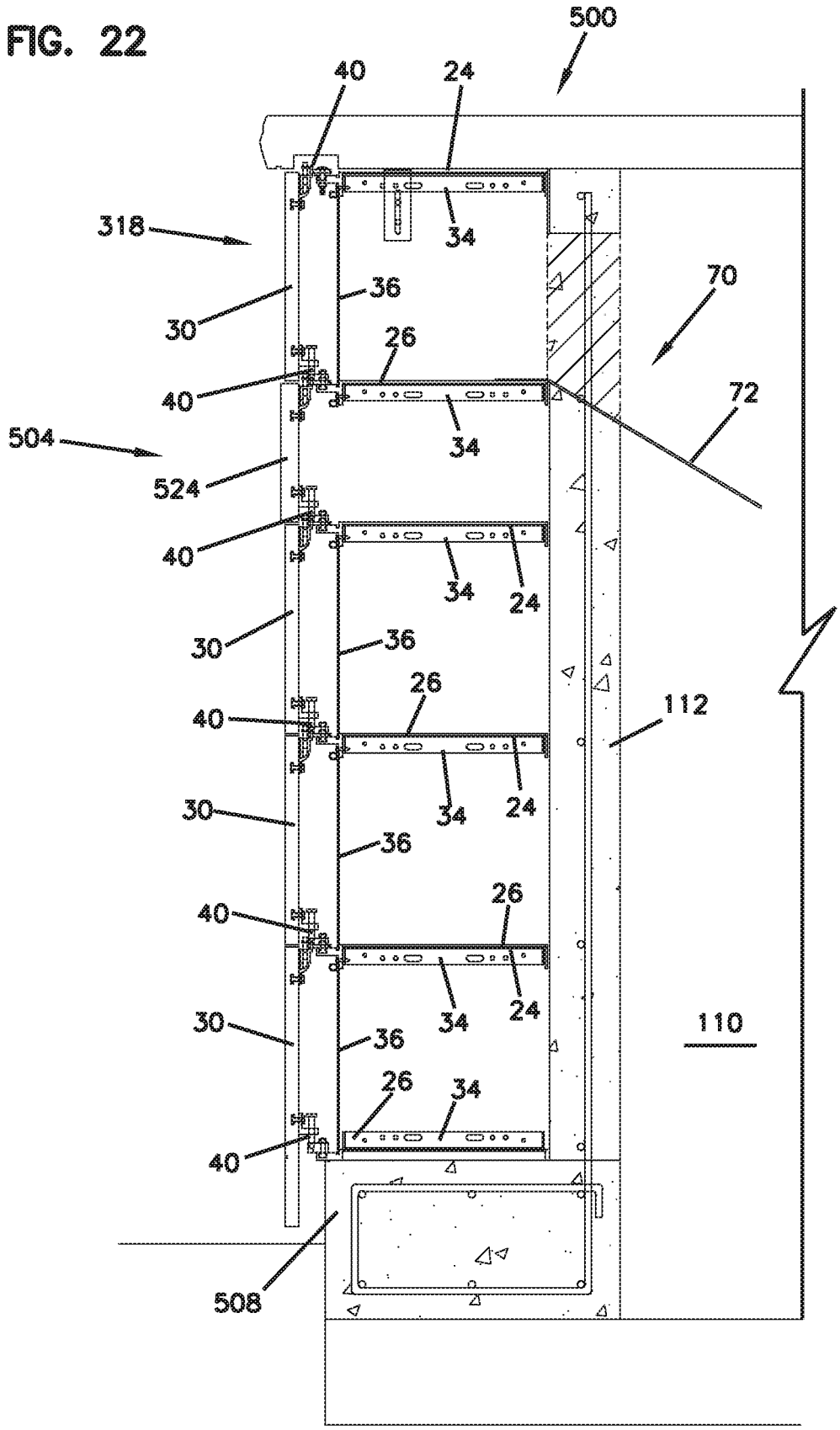
FIG. 22 is a side sectional view of the niches taken through an access niche for the columbarium and ossuary shown in FIG. 20.

Referring now to FIGS. 20-22, there is shown a further embodiment of an example columbarium with a center ossuary, generally designed (500). The columbarium (500) includes a cover (506) with 20 sides and reflects that the columbarium has an array (502) of columns and rows of individual niches (514) with 20 columns of niches (514) disposed about a periphery of the columbarium. The columbarium (500) includes a memorial band (504) having a plurality of memorial band panels (524). The memorial band panels (524) protrude slightly outward from the panels of the niches (514). Moreover, the memorial band (504) may use a different stone, a stone with a different color or finish or other differences in appearance to set the memorial band (504) apart from the niches (518).

Referring to FIGS. 21 and 22, the columbarium (500) includes the central ossuary (510) formed by a vault wall (512). Two access niches (518) are used to deposit flexible urns into the ossuary (510). In a configuration similar to that shown in FIGS. 18 and 19, the columbarium includes a delivery system (70) with a closable opening (532) formed in the back of the access niche (518). The delivery system (70) includes a fixed slide or ramp (72) with an angled portion projecting inward and downward into the ossuary (510). It can be appreciated however that a pivoting delivery system such as delivery system (50) having a pivoting slide (52) may also be utilized with the columbarium (500). Moreover, although 2 access slides (430) are shown in FIG. 21, the number of access niches (518) and delivery systems (530) could be more or fewer.

Figure 23:
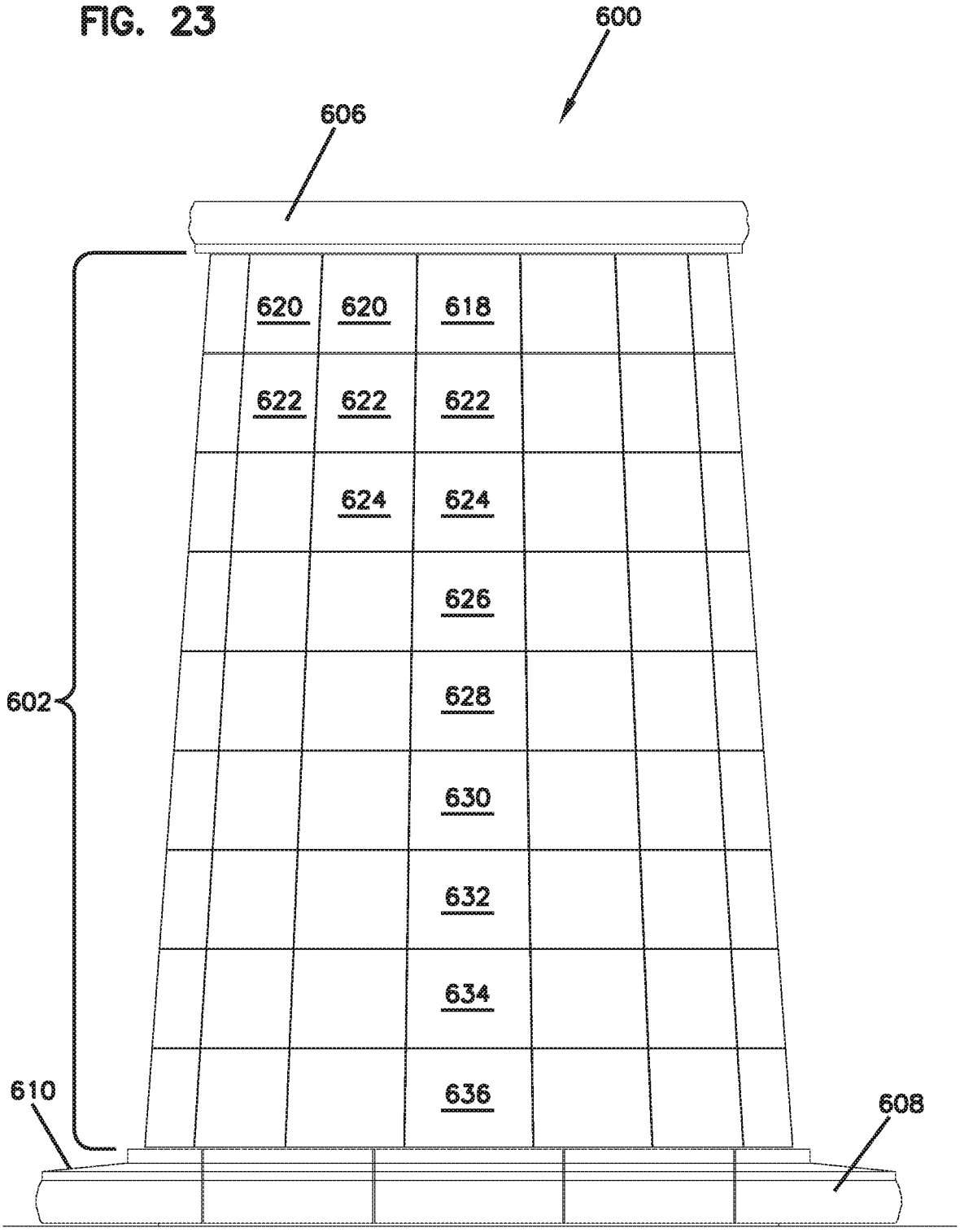
FIG. 23 is a side elevational view of a sixth embodiment of a columbarium and ossuary system according to the principles of the present invention.
Figure 24:
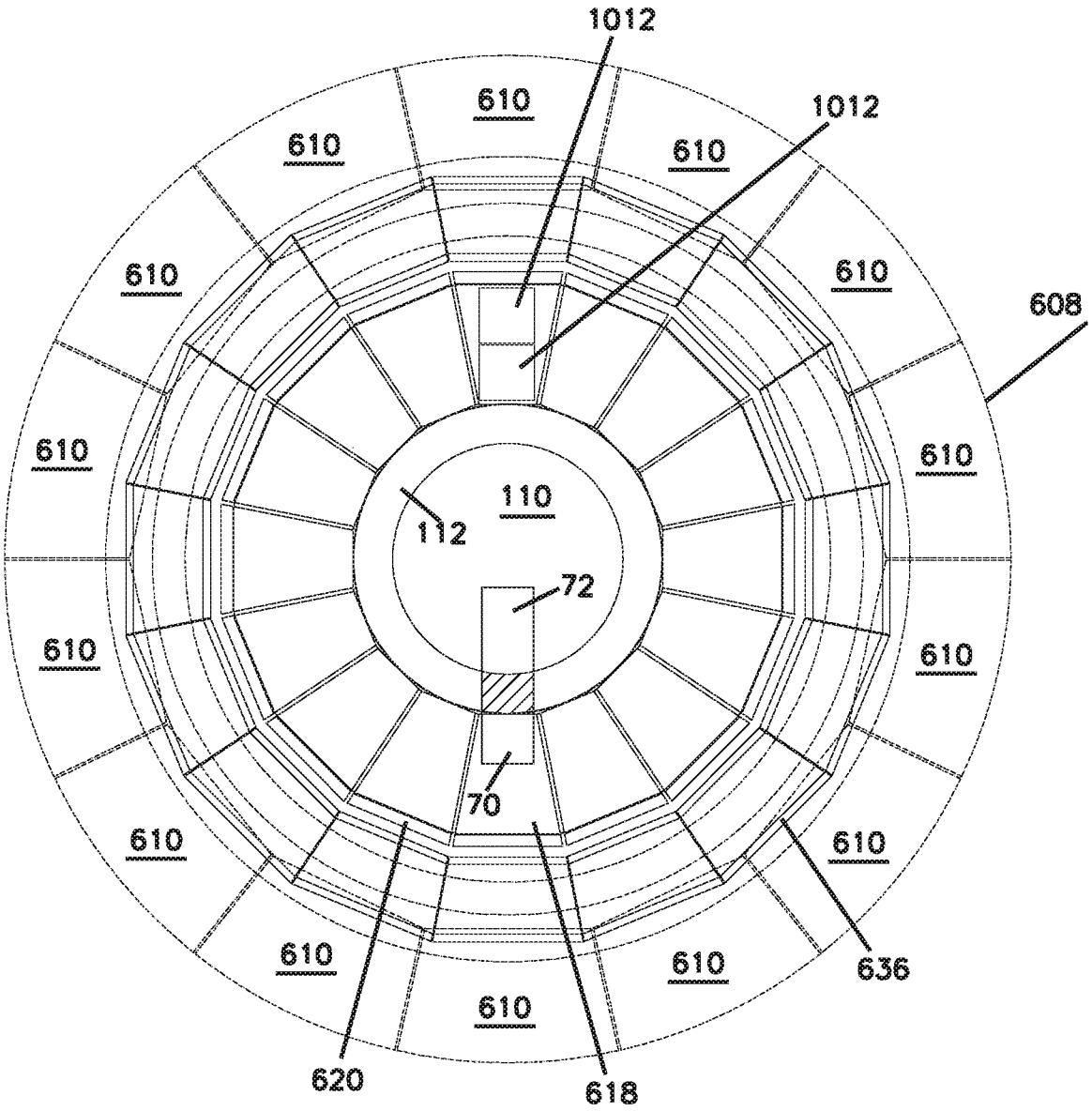
FIG. 24 is a side sectional view taken along line 24-24 of FIG. 23.
Figure 25:
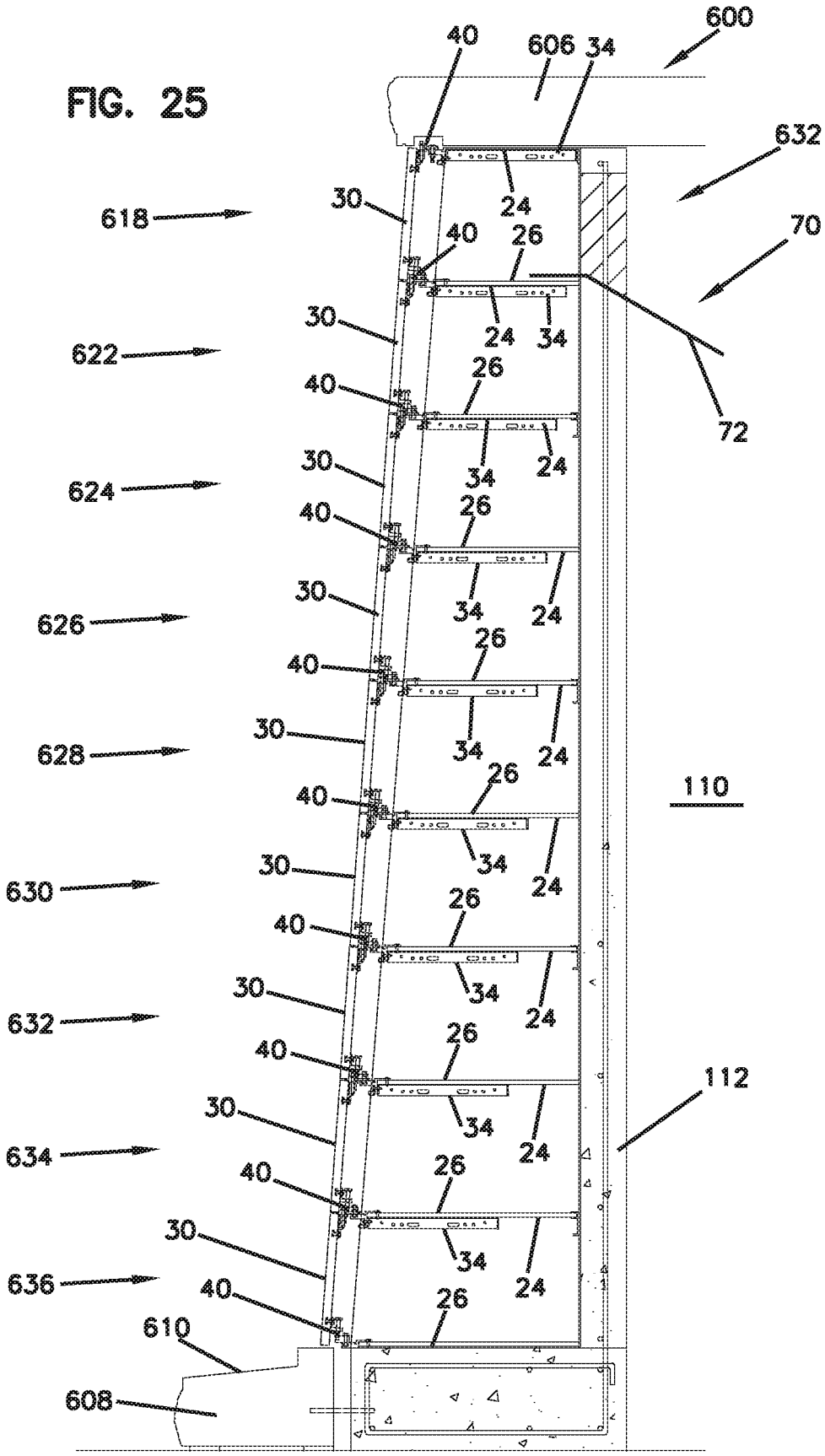
FIG. 25 is a side sectional view of the niches taken through an access niche for the columbarium and ossuary shown in FIG. 23.
Figure 26:
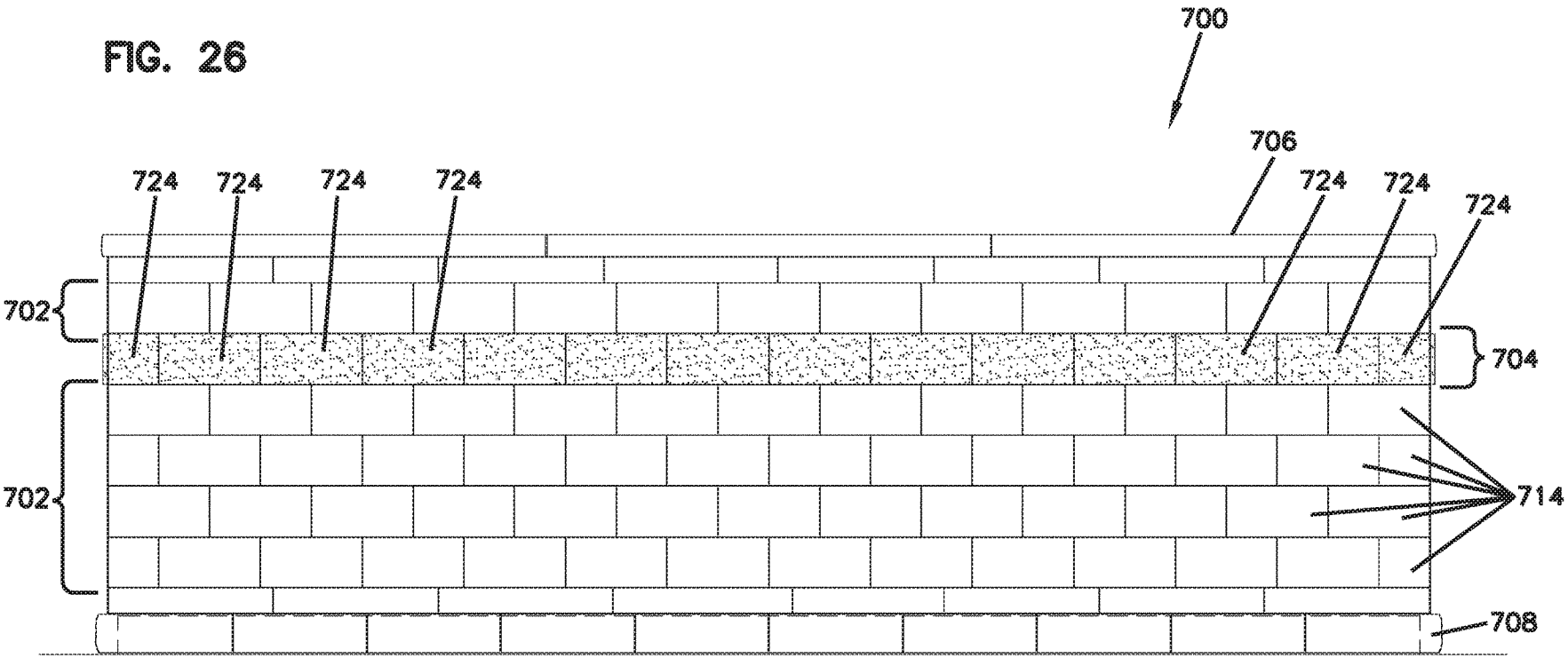
FIG. 26 is a front elevational view of a seventh embodiment of a columbarium and ossuary system according to the principles of the present invention.
Figure 27:
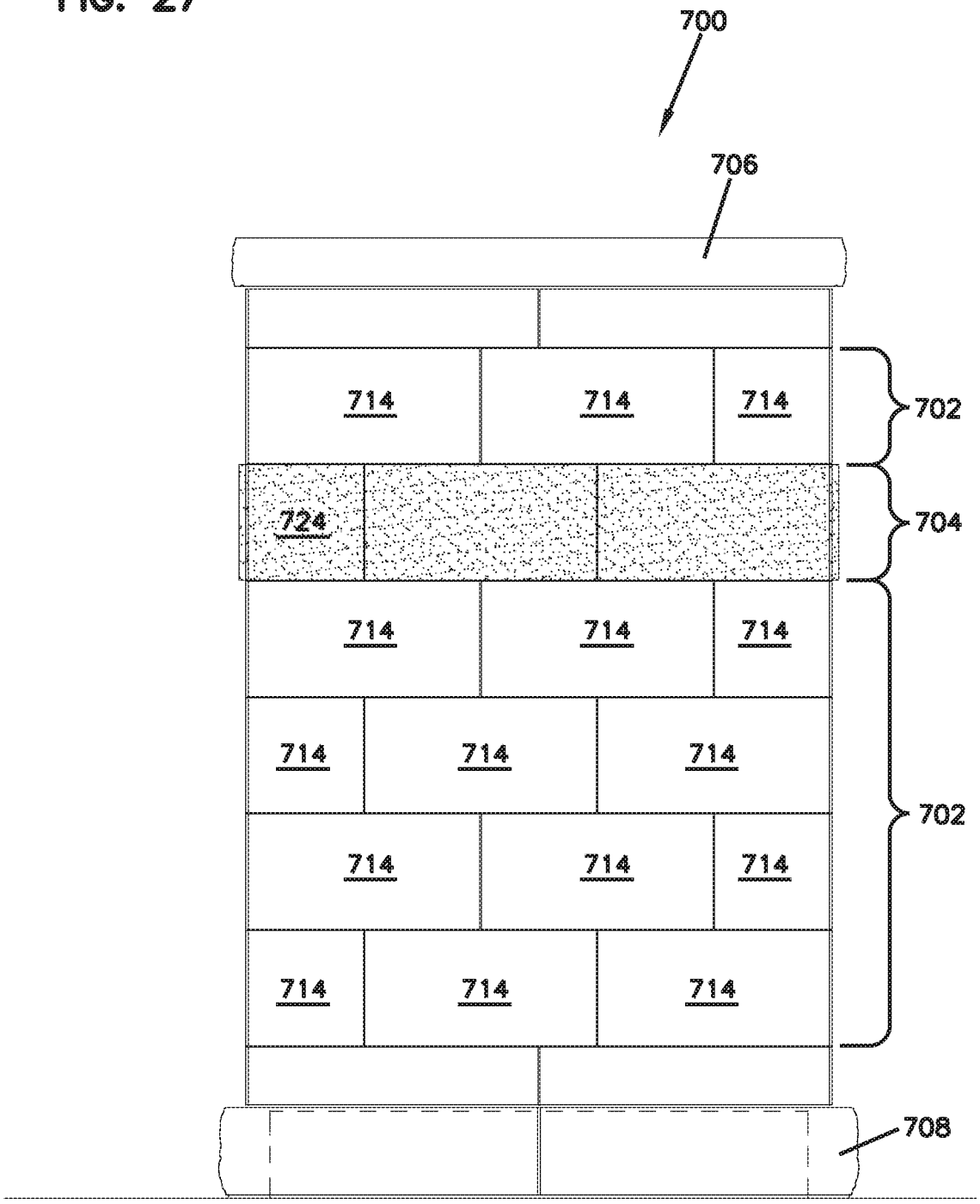
FIG. 27 is an end elevational view of the columbarium shown in FIG. 26.

Referring now to FIGS. 23-25, there is shown a further embodiment of an example columbarium with a center ossuary, generally designed (600). The columbarium (600) includes a cover (606) with a round periphery or 16 sides and to reflect that the columbarium (600) has an array (602) of columns and rows of individual niches (614) with 16 columns of niches (614) disposed about a periphery of the columbarium. The columbarium (600) has a tapered configuration with a wider bottom than top. The niches (620, 622, 624, 626, 628, 630, 632, 634, 636) widen progressively from top to bottom. The stone shutters widen and the niches become progressively deeper from the top row of niches (620) to the bottom row of niches (636).

Referring to FIGS. 24 and 25, the columbarium (500) includes the central ossuary (110) formed by a vault wall (612). At least one access niche (618) is used to deposit flexible urns into the ossuary (110). In a configuration similar to that shown in FIGS. 10 and 11, the columbarium (600) includes a delivery system (70) with a closable opening (632) formed in the back of the access niche (618). The delivery system (70) includes a fixed slide or ramp (72) with an angled portion projecting inward and downward into the ossuary (110). It can be appreciated however that a pivoting delivery system such as delivery system (50) having a pivoting slide (52) may also be utilized with the columbarium (600). Moreover, although one access slides (700) is shown in FIG. 24, there can be additional access niches (618) and delivery systems (70).

The columbarium (600) shown in FIGS. 23-25 includes a widened base (608) extending about a periphery of the columbarium (600). The widened base forms an apron (610) extending radially outward at the base (608). The widened portion provides a surface suitable for inscriptions and may be used to memorialize those interred in the ossuary (110). It can be appreciated that the other example embodiments may also utilize a widened base that may be used for inscriptions. In addition, the widened based may be combined with a memorial band to provide more surface area for inscriptions.

Referring now to FIGS. 26-29, there is shown a further embodiment of an example columbarium with a center ossuary, the columbarium being generally designated (700). The columbarium (700) includes a cover (706) and a base (708). The columbarium (700) has a rectangular configuration with an arrangement (702) of tiers of individual niches (714) on the sides and/or the ends. The columbarium (700) includes a memorial band (704) disposed horizontally about a periphery of the columbarium. The memorial band (704) includes individual panels (724) that may be flush with the outer surface of the arrangement of niches (714) or may protrude slightly outward from the face of the individual niches (714). Moreover, the individual panels (724) of the memorial band may be a different stone, have a contrasting color or surface treatment than the arrangement of niches (702). In this manner, the memorial band (704) may be set apart from the niches (718) and is more visually striking. The columbarium (700) may be quite large but still configured to be constructed remotely and set onto a foundation with a crane.

Figure 10:
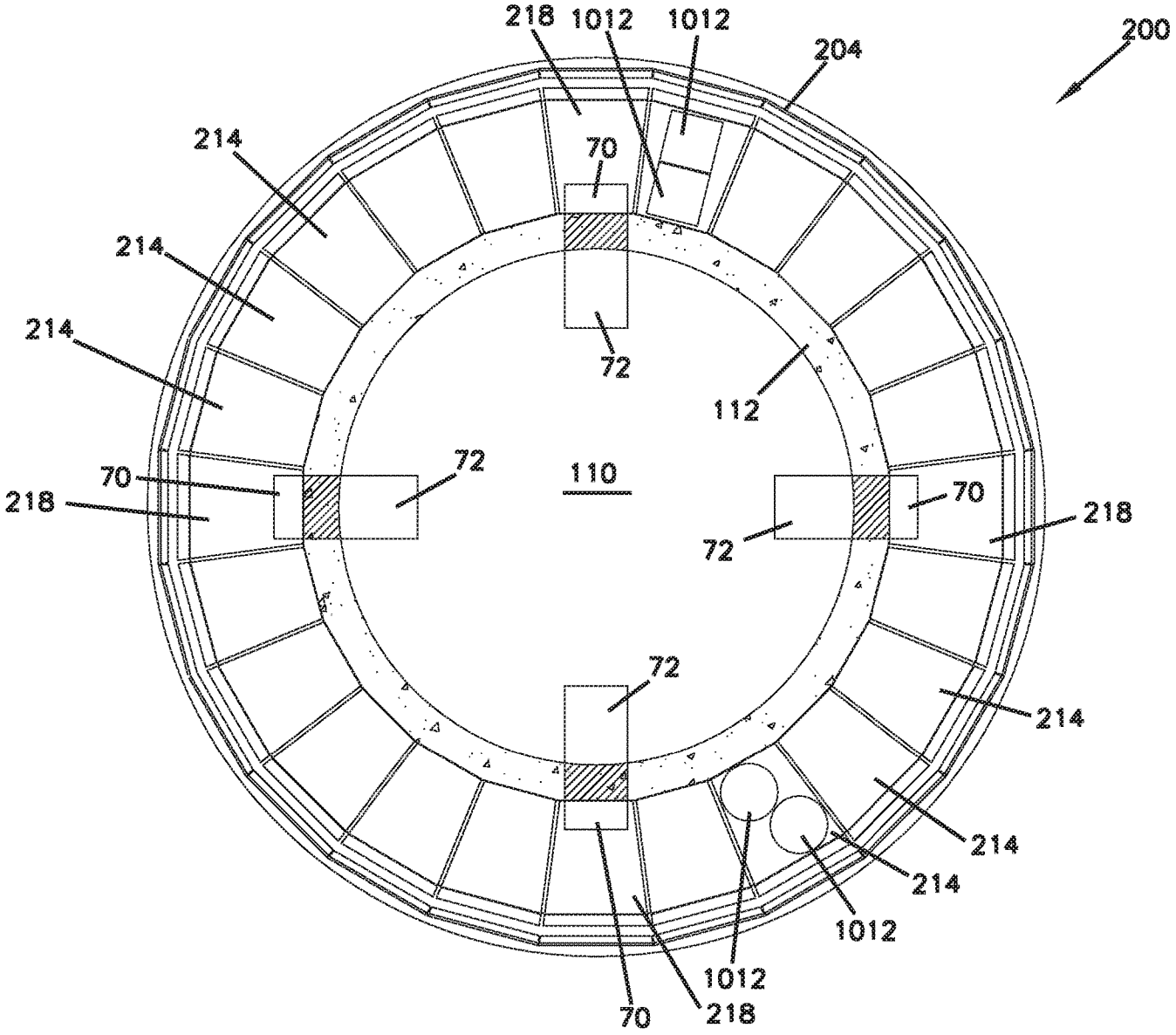
FIG. 10 is a side sectional view taken along line 10-10 of FIG. 9.
Figure 11:
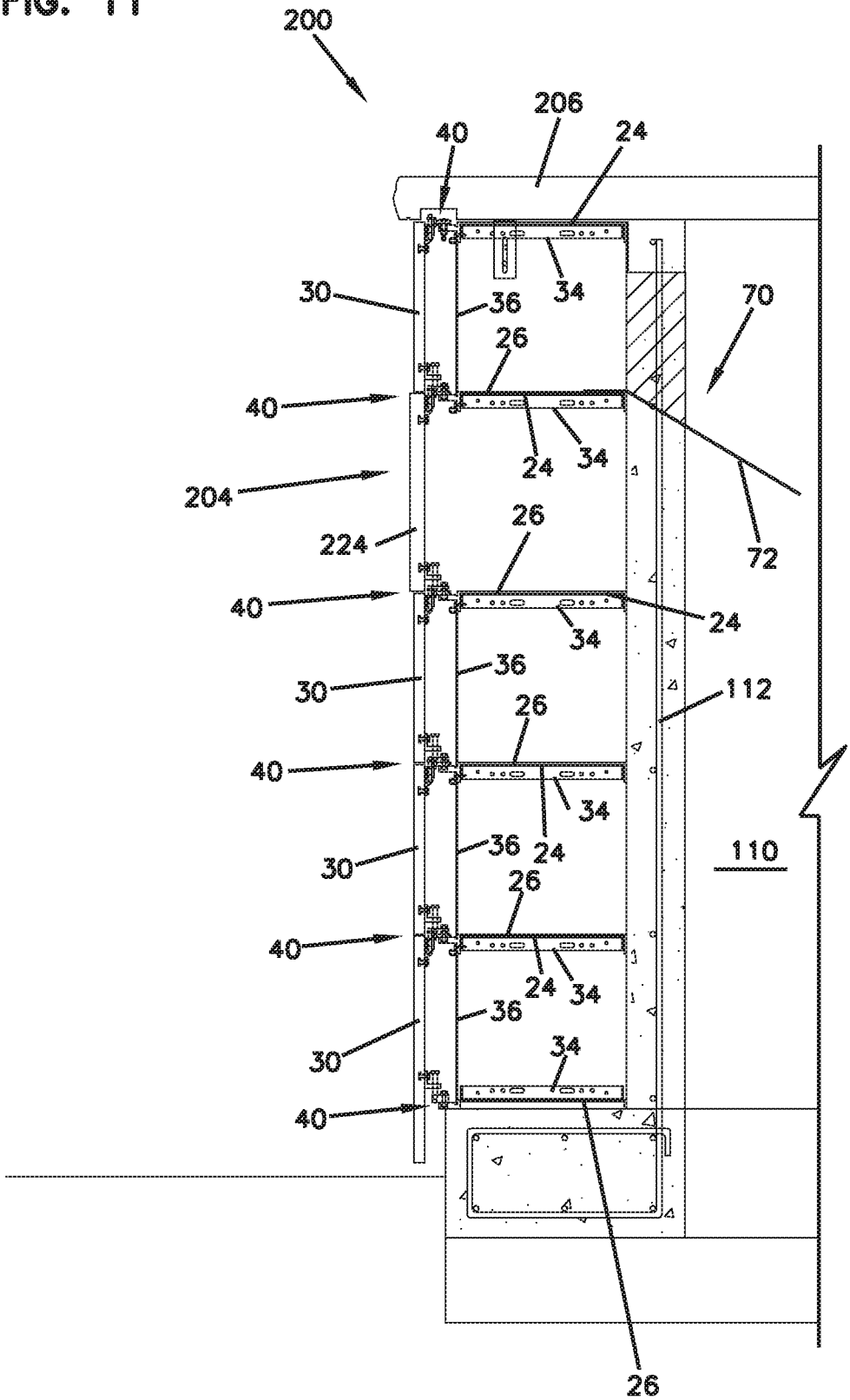
FIG. 11 is a side sectional view of the niches taken through an access niche for the columbarium and ossuary shown in FIG. 8.
Figure 12:
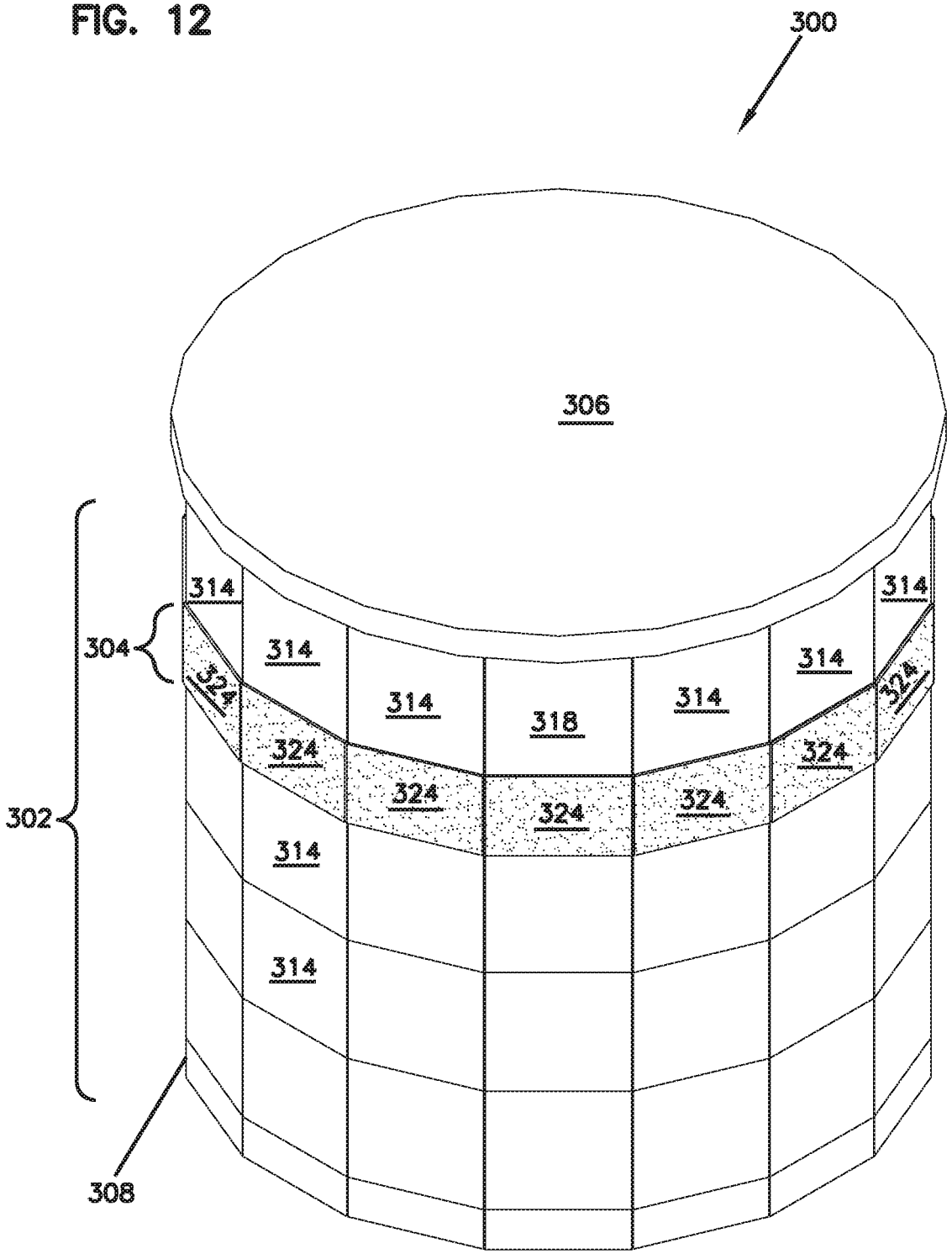
FIG. 12 is a perspective view of a third embodiment of a columbarium and ossuary system according to the principles of the present invention.
Figure 13:
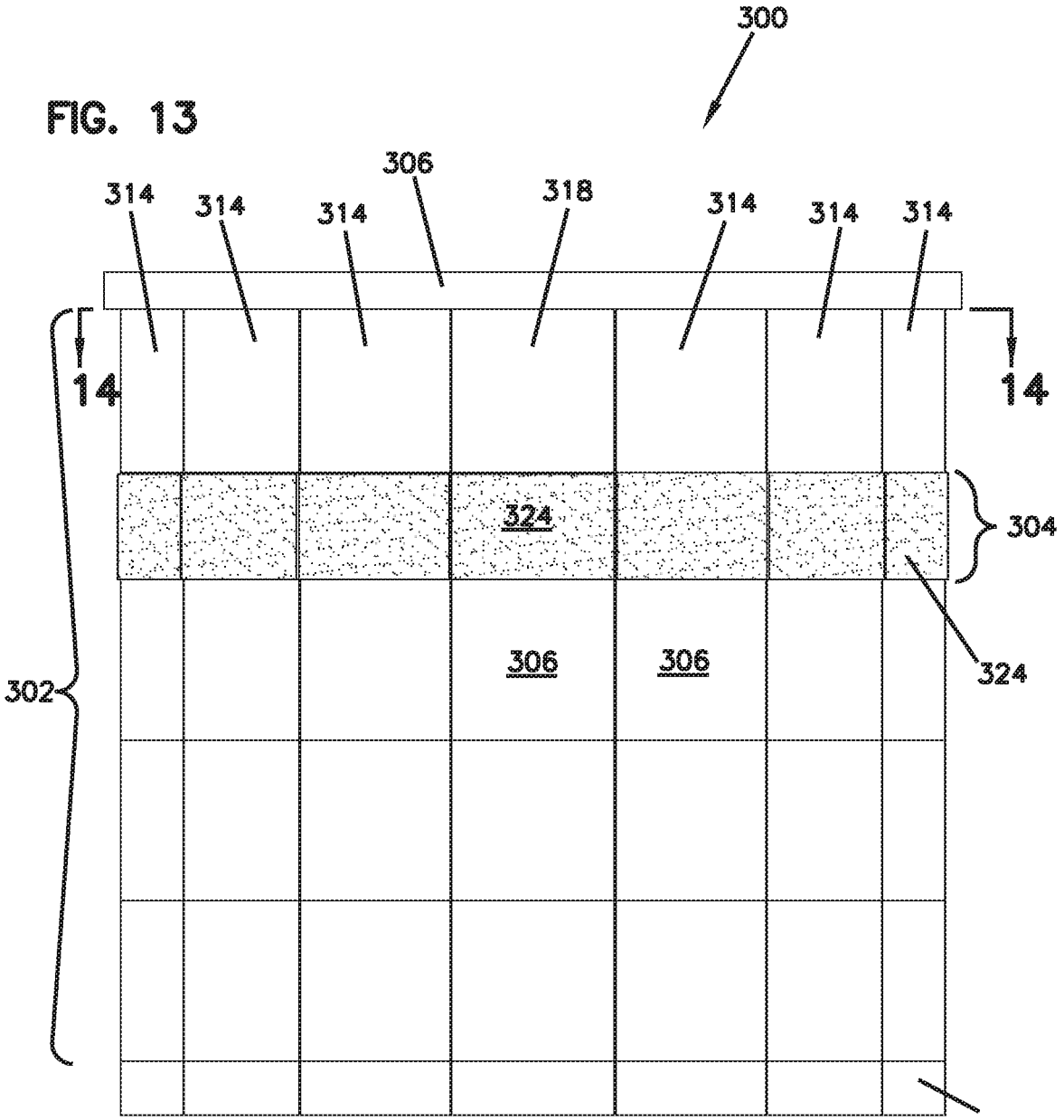
FIG. 13 is a side elevational thereof.
Figure 28:
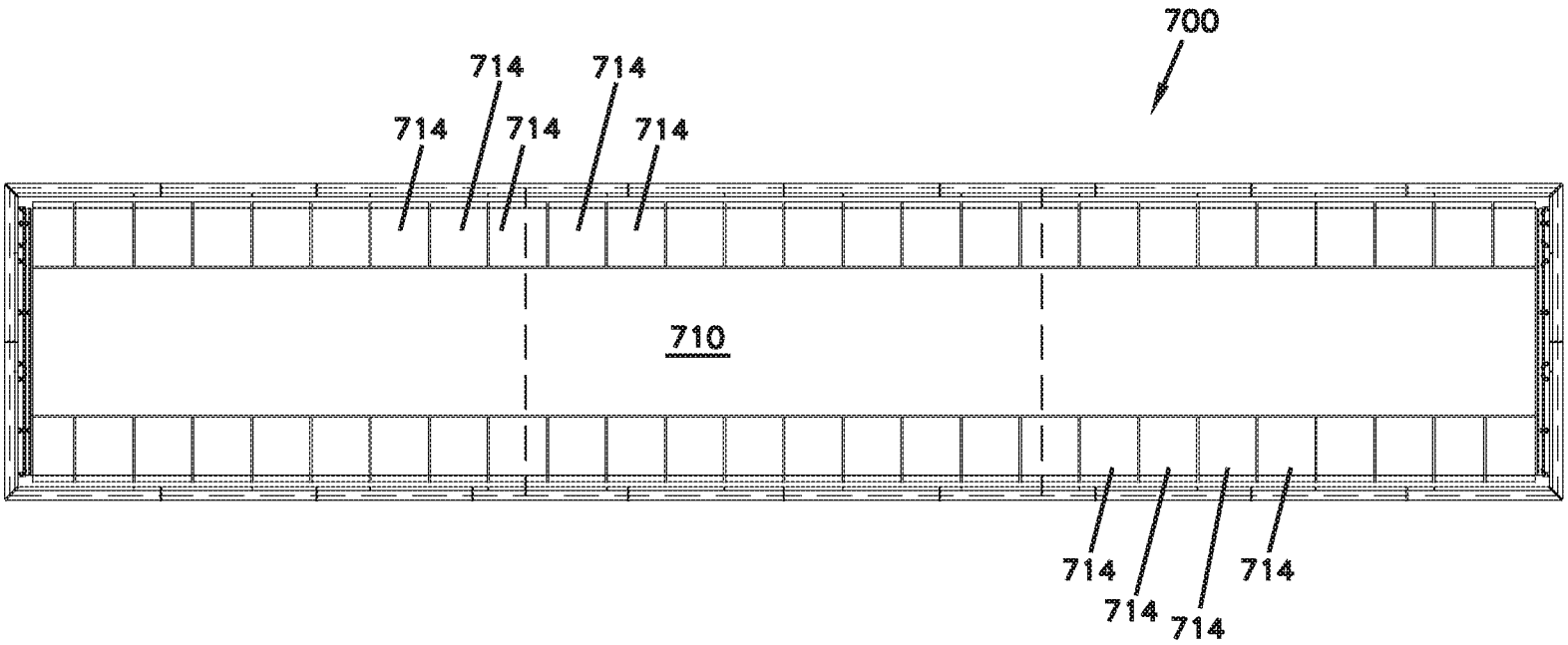
FIG. 28 is a top plan view of the columbarium shown in FIG. 26 with the cover removed for clarity.
Figure 29:
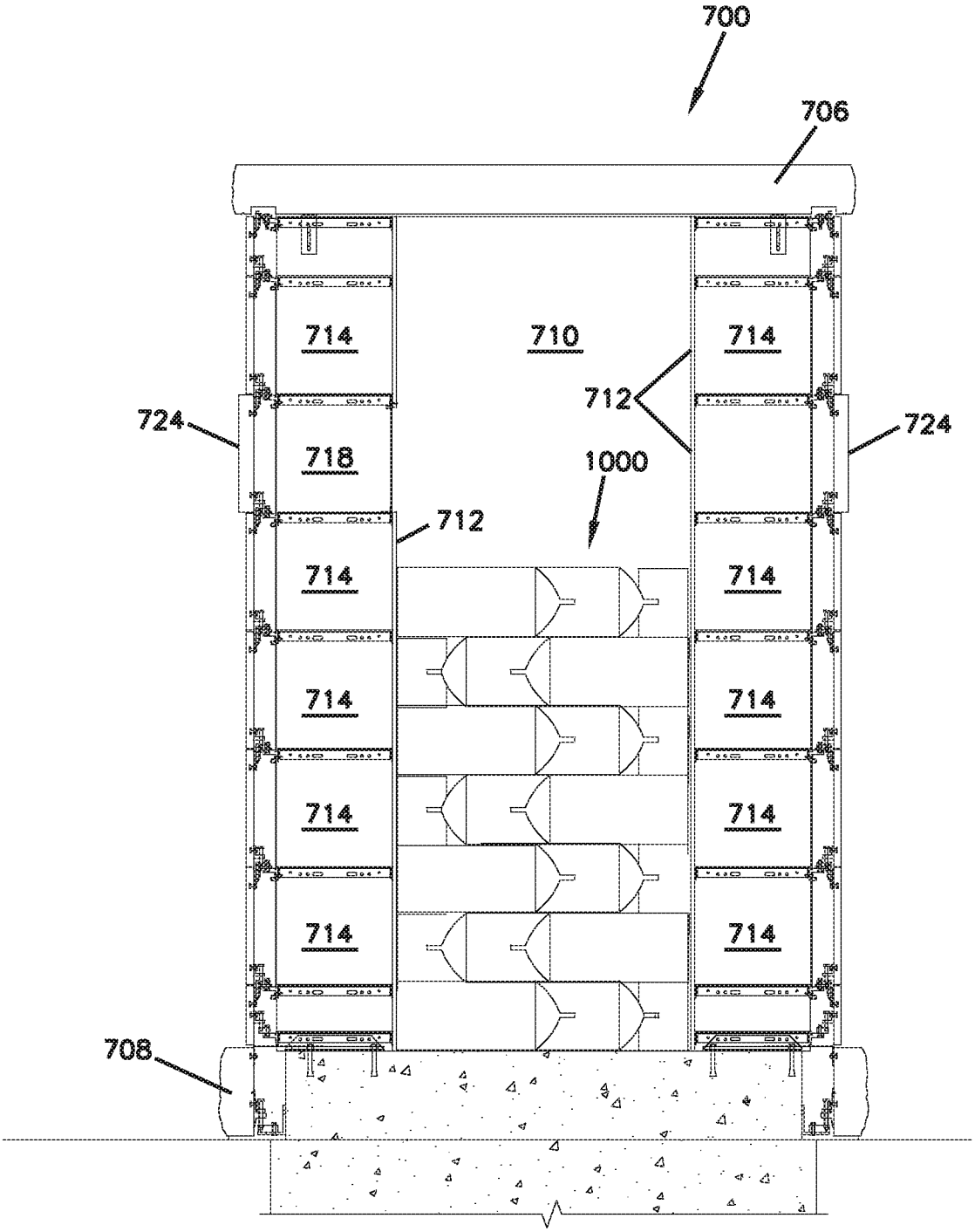
FIG. 29 is an end sectional of the columbarium shown in FIG. 26.

As shown in FIGS. 28 and 29, the columbarium (700) includes a central ossuary (710) formed by an inner vault wall (712). The central ossuary (710) includes space for receiving flexible urns (1000). In the embodiment shown in FIGS. 28 and 29, the flexible urns (1000) are interred through an access niche or niches (718) behind one or more of the memorial band panels (724). Access is provided by removing the corresponding memorial band panel (724) and depositing the flexible urn through the rear of the access niche (718). It can also be appreciated that as with the other embodiments, the access niche (718) may include delivery system (50), such as shown in FIGS. 3-5, or a delivery system (70), such as shown in FIGS. 10 and 11. Moreover, it can be appreciated that as the columbarium (700) has a substantially great length, multiple access niches (718) may be placed along at least one side of the columbarium (700). Moreover, as areas of the ossuary (710) become filled, an access niche (718) may be closed off and new access niches behind the memorial band (704) may be utilized for depositing the flexible urns (1000) at different locations in the ossuary (710). It can be appreciated that the columbarium (700) may also be configured with fewer or more niches by uses additional or fewer tiers and/or by varying the height, width and length of the columbarium (700).

Although the embodiments shown include a memorial band, inscriptions could also be placed on the cover or base of a columbarium or a combination of a memorial band and/or cover and/or base. It can also be appreciated that although different numbers of niches have been shown in the various embodiments illustrated, the columbarium may have different heights and/or diameters with different numbers of sides to achieve the number of niches required for the storage needs of the installation while still achieving the advantages of a columbarium with a central ossuary and with access niches that provide a delivery system to the central ossuary. Moreover, such systems may also utilize different shapes and sized memorial bands with different numbers of panels or multiple memorial bands to provide inscription surfaces for the cremains stored in the central ossuary.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A columbarium system, comprising:

a plurality of storage niches having a first shape and size and disposed about a surface of the columbarium;

a center chamber having a larger capacity than the storage niches;

an access and delivery system configured to provide access from an exterior at a side of the columbarium to the center chamber;

an inscribable designation section separate from the niches on the side of the columbarium;

a plurality of first urns, each of the first urns being configured for storing in one of the storage niches;

a plurality of second urns, the second urns comprising flexible containers configured for delivery through the access and delivery system from the side of the columbarium to the center chamber.

2. A columbarium, comprising:

a plurality of storage niches having a first shape and size and disposed about a surface of the columbarium;

a base;

a cover;

a center chamber having a larger capacity than the storage niches;

an access passage configured to provide access from an exterior side of the columbarium intermediate the base and the cover to the center chamber; the access passage comprising a removable exterior element and an inner portion openable to the center chamber;

an inscribable side designation section separate from the niches intermediate the base and the cover.

3. The columbarium according to claim 2, the columbarium being configured to inter a plurality of first urns, each of the first urns being configured for storing in one of the storage niches;

a plurality of second urns, the second urns comprising flexible containers configured for delivery through an access and delivery system from the exterior side of the columbarium to the center chamber.

4. The columbarium according to claim 2, comprising a plurality of the access passages.

5. The columbarium according to claim 2, comprising a plurality of the access passages spaced apart about a periphery of the columbarium.

6. The columbarium according to claim 2, wherein the side designation section comprises an inscribable section above the storage niches.

7. The columbarium according to claim 2, wherein the columbarium has a rectangular configuration.

8. The columbarium according to claim 2, wherein the side designation section comprises a removable element.

9. The columbarium according to claim 8, wherein the side designation section comprises a plurality of the removable elements.

10. The columbarium according to claim 2, wherein the side designation section comprises a side designation element having a different shape or size than one of the plurality of storage niches.

11. The columbarium according to claim 10, wherein the side designation element protrudes from a side of the surface beyond the storage niches.

12. The columbarium according to claim 10, wherein the side designation element has a color or finish different than a color or finish of the storage niches.

13. The columbarium according to claim 10, wherein the columbarium comprises a plurality of the side designation elements extending continuously around a periphery of the exterior side of columbarium.

14. The columbarium according to claim 2, further comprising a delivery system for conveying remains from the access passage to the center chamber.

15. The columbarium according to claim 14, wherein the delivery system comprises a slide extending from the access passage to the center chamber.

16. The columbarium according to claim 14, wherein the delivery system comprises a rotatable slide extending from the access passage to the center chamber.

17. The columbarium according to claim 16, wherein the slide closes the access passage in a delivery position.

18. A columbarium, comprising:

a base;

a cover;

a plurality of storage niches disposed about a surface of the columbarium intermediate the base and the cover;

a center chamber having a larger capacity than the storage niches;

a plurality of access passages, each of the plurality of access passages being formed through a periphery of the columbarium intermediate the base and the cover and to the center chamber;

a removable designation element disposed on the periphery of the columbarium intermediate the base and the cover.

19. The columbarium according to claim 18, the columbarium being configured to inter a plurality of first urns, each of the first urns being configured for storing in one of the storage niches;

a plurality of second urns, the second urns comprising flexible containers configured for delivery through an access and delivery system from the surface of the columbarium to the center chamber.

20. The columbarium according to claim 18, wherein the designation element has an appearance contrasting an appearance of covers of the storage niches.

21. A method of interring cremated remains in a columbarium having a center ossuary, the method comprising:

removing an outer cover from an access passage intermediate a base and a cover of the columbarium;

placing a flexible urn containing the remains of a deceased through the access passage and onto a delivery system extending from the access passage to the ossuary;

replacing the outer cover;

inscribing a side designation section with the name of deceased.

22. The method according to claim 21, further comprising tipping a rotatable slide of the delivery system to deposit the remains in the ossuary.

23. The method according to claim 21, wherein the designation section comprises a removable designation element, the method further comprising:

removing designation element;

adding an inscription to the designation element; and replacing the designation element.

24. The method according to claim 23, wherein the columbarium comprises storage niches with covers, and wherein the designation element has an appearance contrasting an appearance of the covers of the storage niches.

* * * * *